US008915071B2

(12) United States Patent
Mitsuda

(10) Patent No.: US 8,915,071 B2
(45) Date of Patent: Dec. 23, 2014

(54) EXHAUST GAS PURIFYING DEVICE

(75) Inventor: Masataka Mitsuda, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 249 days.

(21) Appl. No.: 13/577,364

(22) PCT Filed: Feb. 9, 2011

(86) PCT No.: PCT/JP2011/052770

§ 371 (c)(1),
(2), (4) Date: Aug. 8, 2012

(87) PCT Pub. No.: WO2011/099527

PCT Pub. Date: Aug. 18, 2011

(65) Prior Publication Data

US 2012/0305112 A1 Dec. 6, 2012

(30) Foreign Application Priority Data

Feb. 12, 2010 (JP) ..... 2010-028971
Feb. 26, 2010 (JP) ..... 2010-043195

(51) Int. Cl.
*F01N 3/00* (2006.01)
*F01N 13/00* (2010.01)
*F01N 13/02* (2010.01)

(52) U.S. Cl.
CPC ..... *F01N 13/00* (2013.01); *F01N 13/008* (2013.01); *F01N 13/02* (2013.01)
USPC ..... 60/311; 60/299; 60/295; 60/285

(58) Field of Classification Search
CPC ..... F01N 13/00; F01N 13/02
USPC ..... 60/311, 295
See application file for complete search history.

(56) References Cited

U.S. PATENT DOCUMENTS

2005/0056008 A1 3/2005 Endo

FOREIGN PATENT DOCUMENTS

| | | |
|---|---|---|
| EP | 1914400 A1 * | 4/2008 |
| JP | 2001-073748 | 3/2001 |
| JP | 2004-263593 | 9/2004 |
| JP | 2005-194949 | 7/2005 |
| JP | 2005-195010 | 7/2005 |

(Continued)

OTHER PUBLICATIONS

English Tran. JP 2005-194949 and JP2004-263593 (References provided in Applicants IDS).*

*Primary Examiner* — Thomas Denion
*Assistant Examiner* — Anthony Ayala Delgado
(74) *Attorney, Agent, or Firm* — Jordan and Hamburg LLP

(57) ABSTRACT

Provided is an exhaust gas purifying device which can improve handling work ability such as maintenance of an engine while it can improve a purifying performance of an exhaust gas of the engine. The exhaust gas purifying device is provided with a plurality of gas purifying bodies which purifies the exhaust gas discharged by the engine, a plurality of inside cases which are inward provided with the gas purifying bodies, and outside which are inward provided with the inside cases. An outlet end portion of an inside case in an exhaust gas upstream side and an inlet end portion of an in an exhaust gas downstream side are superposed as a double structure. Sensor boss bodies for supporting exhaust gas sensors are arranged in an outside surface of the outlet end portion or the inlet end portion of the double structure. The sensor boss bodies are extended to an outside direction of the outside case.

10 Claims, 25 Drawing Sheets

(56) References Cited

FOREIGN PATENT DOCUMENTS

| | | |
|---|---|---|
| JP | 2005-207410 | 8/2005 |
| JP | 2009-091982 | 4/2009 |
| JP | 2009-091983 | 4/2009 |
| JP | 2009-228516 | 10/2009 |

* cited by examiner

EXHAUST GAS PURIFYING DEVICE

BACKGROUND OF THE INVENTION

The present invention relates to an exhaust gas purifying device which is mounted to a diesel engine or the like, and more particularly to an exhaust gas purifying device which removes a particulate matter (a soot and a particulate) and the like which are included in an exhaust gas.

Conventionally, there has been known a technique which is provided in an exhaust route of a diesel engine with a diesel particulate filter (hereinafter, refer to as DPF) as an exhaust gas purifying device (an after treatment device), for purifying an exhaust gas which is discharged form the diesel engine by the DPF (refer, for example, to patent document 1).

Further, in the DPF, there has been also known a technique which is provided with a temperature sensor which detects a temperature of an exhaust gas discharged from a diesel engine, and a pressure sensor which detects a pressure of the exhaust gas discharged from the diesel engine (refer, for example, to patent documents 1 and 2).

Further, in the DPF, there has been known a technique which is provided with an inside case as a double structure in an inner portion of an outside case, and is inward provided with an oxidation catalyst or a soot filter in the inside case (refer, for example, to patent document 3).

Further, in the DPF, there has been known a technique which couples a case having an oxidation catalyst therein, and a case having a soot filter therein, so as to be separable via a flange which is fastened by a bolt (refer, for example, to patent documents 4 to 5).

Citation List

Patent Document 1: Japanese Unexamined Patent Publication No. 2004-263593

Patent Document 2: Japanese Unexamined Patent Publication No. 2001-73748

Patent Document 3: Japanese Unexamined Patent Publication No. 2005-194949

Patent Document 4: Japanese Unexamined Patent Publication No. 2009-228516

Patent Document 5: Japanese Unexamined Patent Publication No. 2009-91982

SUMMARY OF THE INVENTION

In the prior art, in the case of arranging the exhaust gas temperature sensor which detects the temperature of the exhaust gas discharged form the diesel engine, and the exhaust gas pressure sensor which detects the pressure of the exhaust gas, in the structure which couples the single structure case inward provided with the oxidation catalyst, and the single structure case inward provided with the soot filter, the exhaust gas temperature in the inner portion of the case tends to be lowered, and an outer surface of the case tends to come to a high temperature, by forming a support portion of the exhaust gas temperature sensor and a pickup portion of the exhaust gas for detecting the pressure in the single structure case between the oxidation catalyst and the soot filter.

In other words, since the exhaust gas temperature in the inner portion of the case is lowered, the particulate matter in the exhaust gas tends to clog the soot filter, and it is necessary to regenerate the soot filter at a high frequency, so that there is such a problem that it is impossible to improve a purifying performance of the exhaust gas. On the other hand, since the outer surface of the case comes to a high temperature, it is necessary to carry out a maintenance of the diesel engine after the case is cooled down, so that there is such a problem that it is impossible to improve a handling workability.

Further, in the prior art, since it is necessary to evaluate an initial setting (adjusting) condition of the exhaust gas pressure sensor per plural specifications of engines or machine bodies, in the case that the exhaust gas pressure sensor for detecting the pressure of the exhaust gas is provided in the engine or the machine body side, there is such a problem that it is impossible to reduce an evaluating man power for a design of assembling the DPF to the engine, a test and the like. It is not necessary to evaluate the DPF for each of the plural specifications of engines, by arranging the exhaust gas pressure sensor in the DPF, however, there is such a problem that it is impossible to easily secure a strength of the exhaust gas purifying case which constructs the DPF, or a support strength of the exhaust gas pressure sensor.

On the other hand, it is necessary to connect the exhaust gas pressure sensor to the DPF, thereafter connect a sensor piping to the DPF and the exhaust gas pressure sensor, and communicate the exhaust gas pressure sensor to the DPF. There is such a problem that it is impossible to easily simplify an assembling work of the exhaust gas purifying case to the engine or the like. Further, in the structure in which the sensor piping connecting the exhaust gas pressure sensor to the DPF is extended to the engine or the machine body side from the DPF, a worker or a tool tends to come into contact with the sensor piping at a time of an assembling work or a maintenance work of the engine and the DPF, so that there is such a problem that it is impossible to easily protect the sensor piping or the like, and it is impossible to improve a handling workability.

Accordingly, the present invention intends to provide an exhaust gas purifying device to which an improvement is applied by making a study of these actual conditions.

According to a first aspect of the present invention, there is provided an exhaust gas purifying device comprising: a plurality of gas purifying bodies which purifies an exhaust gas discharged by an engine; a plurality of inside cases which is inward provided with the respective gas purifying bodies; and outside cases which are inward provided with respective the inside cases, wherein an outlet end portion of the inside case in an exhaust gas upstream side and an inlet end portion of the inside case in an exhaust gas downstream side are superposed as a double structure, a sensor boss body for supporting an exhaust gas sensor is arranged in an outside surface of the outlet end portion or the inlet end portion of the double structure, and the sensor boss body is extended to an outside direction of the outside case.

According to a second aspect of the present invention, in the exhaust gas purifying device described in the first aspect, a heat shield case is provided in an outside surface of one of the inside case, the other of the inside case is inserted into the heat shield case, one end side of the heat shield case is firmly fixed to an outer peripheral surface in an inner side than an end surface of the one of the inside case, and the sensor boss body is firmly fixed to an outer peripheral surface of the heat shield case in the vicinity of the end surface of the one of the inside case.

According to a third aspect of the present invention, in the exhaust gas purifying device described in the second aspect, an inner diameter of a firmly fixing position of the sensor boss body in the heat shield case is formed larger than an outer diameter of the inside case.

According to a fourth aspect of the present invention, in the exhaust gas purifying device described in the second aspect, one end side of the heat shield case is fitted to the inside case, and the other end side of the heat shield case is coupled to a flange body for bonding the outside cases.

According to a fifth aspect of the present invention, in the exhaust gas purifying device described in the second aspect, a sensor attaching hole of the outside case is occluded by the heat shield case.

According to a sixth aspect of the present invention, in the exhaust gas purifying device described in the second aspect, a space is formed between an outer peripheral side of the other of the inside case in which the other end side of the heat shield case is extended, and an inner peripheral side of the heat shield case.

According to a seventh aspect of the present invention, in the exhaust gas purifying device described in the second aspect, the other end side of the heat shield case which is extended to the outside surface of the other of the inside case is coupled to a flange body for connecting the outside case.

According to an eighth aspect of the present invention, in the exhaust gas purifying device described in the second aspect, the inside case, the heat shield case and the outside case are provided as a three-layer structure, a side end of the heat shield case is formed shorter than a side end of the outside case, and a side end of the inside case is formed shorter than a side end of the heat shield case.

According to a ninth aspect of the present invention, in the exhaust gas purifying device described in the first aspect, the exhaust gas pressure sensor is arranged in an outside surface of the outside case, a pipe joint body for connecting the sensor piping is fastened to the sensor boss body via a pipe joint bolt, and the exhaust gas pressure sensor is connected to the sensor boss body via the sensor piping.

According to a tenth aspect of the present invention, in the exhaust gas purifying device described in the ninth aspect, a sensor support portion is integrally formed in a part of a flange body for pinching in the outside case, and a sensor bracket for attaching the exhaust gas pressure sensor is detachably provided in the sensor support portion.

According to an eleventh aspect of the present invention, in the exhaust gas purifying device described in the ninth aspect, the sensor piping is extended from the sensor piping body toward the exhaust gas pressure sensor, along an outer peripheral shape of the exhaust gas purifying case.

According to the first aspect of the present invention, in the exhaust gas purifying device which is provided with the plurality of gas purifying bodies which purifies the exhaust gas discharged by the engine, the plurality of inside cases which is inward provided with the respective gas purifying bodies, and the outside case which are inward provided with the respective inside cases, the outlet end portion of the inside case in the exhaust gas upstream side and the inlet end portion of the inside case in the exhaust gas downstream side are superposed as the double structure, the sensor boss body for supporting the exhaust gas sensor is arranged in the outside surface of the outlet end portion or the inlet end portion of the double structure, and the sensor boss body is extended to the outside direction of the outside case. Accordingly, it is possible to easily assemble the pipings of the exhaust gas temperature sensor and the exhaust gas pressure sensor and the like via the sensor boss body. Further, it is possible to easily reduce the lowering of the exhaust gas temperature within the inside case on the basis of a heat insulating (a heat keeping) action of the outside case. It is possible to reduce a stay of the particulate matter in the exhaust gas in the inner portion of the gas purifying body (the soot filter) by maintaining the exhaust gas temperature in the inner portion of the inside case, whereby it is not necessary to regenerate the gas purifying body at a high frequency, and it is possible to improve a purifying performance of the exhaust gas. On the other hand, since a rise of an outer surface temperature of the outside case is suppressed, it is possible to carry out a maintenance of the engine before the engine or the like is cooled, and it is possible to improve a handling workability.

According to the second aspect of the present invention, the heat shield case is provided in the outside surface of the one of the inside case, the other of the inside case is inserted into the heat shield case, the one end side of the heat shield case is firmly fixed to the outer peripheral surface in the inner side than the end surface of the one of the inside case, and the sensor boss body is firmly fixed to the outer peripheral surface of the heat shield case in the vicinity of the end surface of the one of the inside case. Accordingly, it is possible to extend the outside case and the heat shield case to the position at which the gas purifying bodies are opposed, and it is possible to easily maintain the exhaust gas temperature in the inner portion of the inside case by the outside case and the heat shield case. Further, it is possible to make a distance between the opposed gas purifying bodies at a shortest dimension while forming the inside cases in the same diameter. In other words, in comparison with the conventional structure in which the expanded portion is provided, it is possible to form the distance between the gas purifying body end surface and the attaching position of the exhaust gas sensor at a shortest dimension (0 or an optional dimension) without being affected by an expansion margin of the inside case, a radius and a welding margin of the sensor boss body and the like. As a result, it is possible to shorten a whole length of the exhaust gas purifying device (DPF) and it is possible to easily mount the DPF on various equipment. It is possible to make the exhaust gas sensor close to the end surface of the gas purifying body until it comes into contact with the end surface of the gas purifying body, and it is possible to improve a control performance of an automatic regeneration or the like of the DPF.

According to the third aspect of the present invention, the inner diameter of the firmly fixing position of the sensor boss body in the heat shield case is formed larger than the outer diameter of the inside case. Accordingly, since a gap is formed between the heat shield case and the inside case which is inward inserted to the heat shield case, it is possible to easily extract the heat shield case and the inside case. Further, it is possible to improve a heat insulating property of the opposed position of the gas purifying bodies, by the heat shield case and the outside case. It is possible to easily maintain a treating temperature of the particulate matter which the gas purifying body collects.

According to the fourth aspect of the present invention, the one end side of the heat shield case is fitted to the inside case, and the other end side of the heat shield case is coupled to the flange body for bonding the outside cases. Accordingly, it is possible to support the heat shield case at a high rigidity by the inside case and the flange body. It is possible to easily prevent the exhaust gas within the inside case from leaking from the gap with the heat shield case toward the outside case. It is possible to reduce a rise of a surface temperature of the outside case.

According to the fifth aspect of the present invention, the sensor attaching hole of the outside case is occluded by the heat shield case. Accordingly, it is possible to easily couple the exhaust gas sensor to a measuring portion by making the sensor boss body protrude to an outside direction of the outside case. It is possible to easily extend an electric wiring, a piping and the like from the sensor boss body side. Further, it is possible to easily prevent the exhaust gas within the inside case from leaking from the sensor attaching hole. It is possible to reduce a rise of the surface temperature of the outside case.

According to the sixth aspect of the present invention, the space is formed between the outer peripheral side of the other of the inside case in which the other end side of the heat shield case is extended, and the inner peripheral side of the heat shield case. Accordingly, it is possible to easily make the other of the inside case come in and out with respect to the heat shield case, and it is possible to easily bond or separate the inside cases and the outside cases. It is possible to improve a maintenance workability of the gas purifying bodies or the exhaust gas sensor.

According to the seventh aspect of the present invention, the other end side of the heat shield case which is extended to the outside surface of the other of the inside case is coupled to the flange body for connecting the outside case. Accordingly, it is possible to easily prevent the exhaust gas from leaking from the gas purifying body toward the outside case. On the basis of the heat insulating action of the outside case and the heat shield case, it is possible to reduce the lowering of the exhaust gas temperature of the gas purifying body and the rise of the surface temperature of the outside case.

According to the eighth aspect of the present invention, the inside case, the heat shield case and the outside case are provided as the three-layer structure, the side end of the heat shield case is formed shorter than the side end of the outside case, and the side end of the inside case is formed shorter than the side end of the heat shield case. Accordingly, it is possible to reduce the temperature lowering of the exhaust gas, and it is possible to improve a treating efficiency of the particulate matter in the exhaust gas. It is possible to reduce the rise of the surface temperature of the outside case, and it is possible to improve a workability of a maintenance of a diesel engine which is necessary during an operation.

According to the ninth aspect of the present invention, the exhaust gas pressure sensor is arranged in the outside surface of the outside case, the pipe joint for connecting the sensor piping is fastened to the sensor boss body via the pipe joint bolt, and the exhaust gas pressure sensor is connected to the sensor boss body via the sensor piping. Accordingly, it is not necessary to evaluate an initial setting (adjusting) condition of the exhaust gas pressure sensor per the plural specifications of engines or machine bodies. It is possible to reduce an evaluating man power for a design, a test and the like of assembling the DPF in the engine. Since it is not necessary to evaluate the DPF for each of the plural specifications of engines by arranging the exhaust gas pressure sensor in the DPF, it is possible to reduce a manufacturing cost by standardizing the constructing parts relevant to the DPF, and reducing the number of the constructing parts relevant to the DPF. It is not necessary to evaluate the exhaust gas pressure sensor per the plural specifications of engines and machine bodies, and it is possible to improve a detecting precision of the exhaust gas pressure sensor as well as reducing a development cost.

According to the tenth aspect of the present invention, the sensor support portion is integrally formed in the part of the flange body for pinching in the outside case, and the sensor bracket for attaching the exhaust gas pressure sensor is detachably provided in the sensor support portion. Accordingly, it is possible to support the exhaust gas pressure sensor to the flange body having a high rigidity, and it is possible to reduce a vibration of the exhaust gas pressure sensor. It is possible to prevent the exhaust gas pressure sensor from falling away. It is possible to easily secure a strength of the exhaust gas purifying case which constructs the DPF, or a support strength of the exhaust gas pressure sensor.

According to the eleventh aspect of the present invention, the sensor piping is extended from the sensor piping body toward the exhaust gas pressure sensor, along the outer peripheral shape of the exhaust gas purifying case. Accordingly, it is possible to compactly arrange the sensor piping to an outer periphery of the DPF. Further, it is possible to extend the sensor piping in an optional direction from the pipe joint body toward the exhaust gas pressure sensor. It is possible to improve an assembling workability of the exhaust gas purifying case to the engine or the like. In comparison with the conventional structure in which the sensor piping is extended from the DPF to the engine or the machine body side, the worker or the tool is hard to come into contact with the sensor piping or the like at a time of the assembling work and the maintenance work of the engine and the DPF, and it is easily protect the sensor piping or the like. It is possible to improve a handling workability of a carriage of the DPF.

DESCRIPTION OF THE PREFERRED EMBODIMENTS

A description will be given below of a first embodiment of an exhaust gas purifying device obtained by embodying the present invention on the basis of the accompanying drawings with reference to FIG. 1 to FIG. 20. It is provided with a continuous regeneration type diesel particulate filter 1 (hereinafter, refer to as DPF 1) as an exhaust gas purifying device. It is structured such that the DPF 1 reduces a carbon monoxide (CO) and a hydro carbon (HC) in an exhaust gas of a diesel engine 70, in addition to a removal of a particulate matter (PM) in the exhaust gas of the diesel engine 70.

Figure 1:
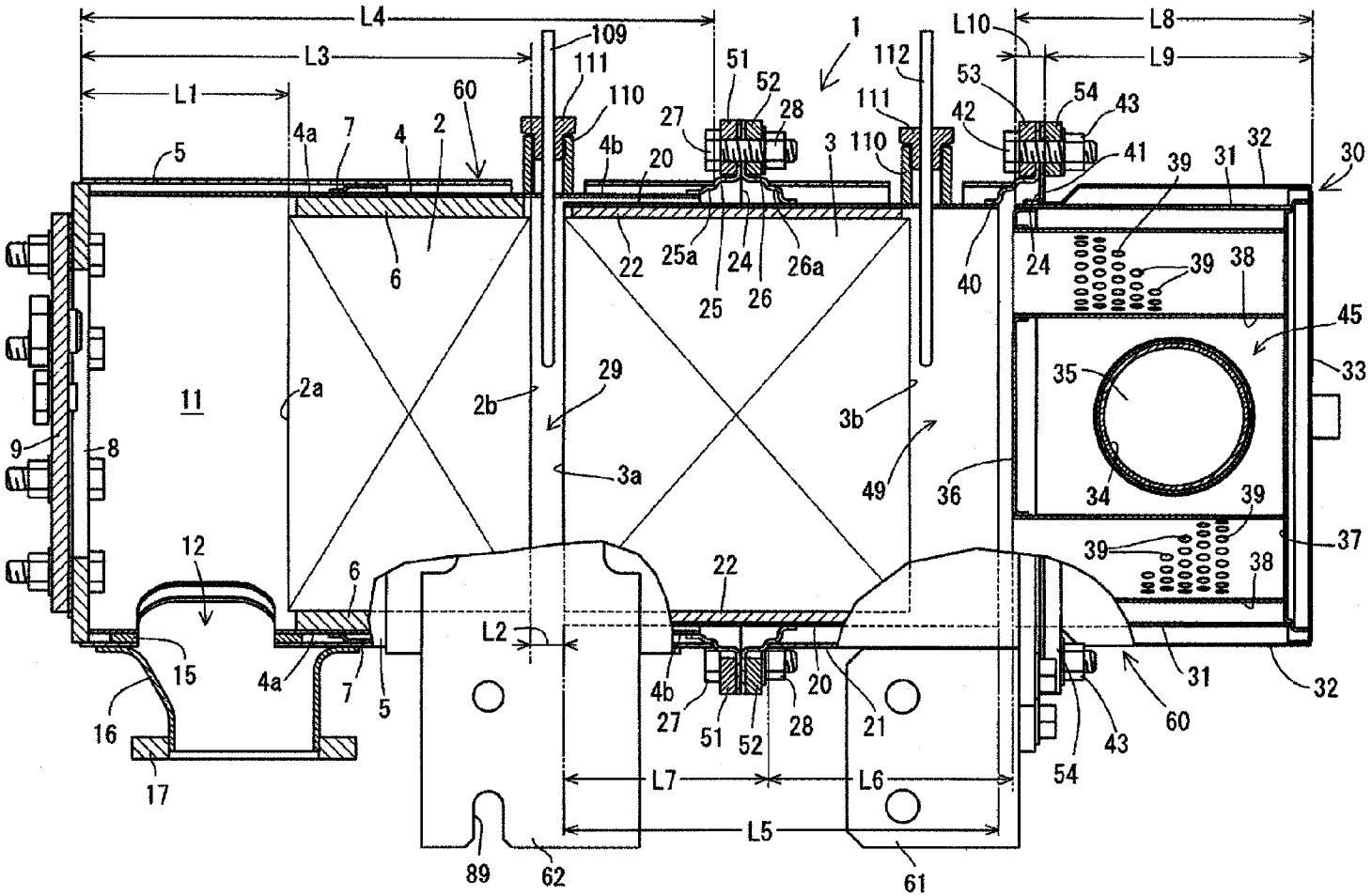
FIG. 1 is a cross sectional explanatory view of a DPF and shows a first embodiment.
Figure 2:
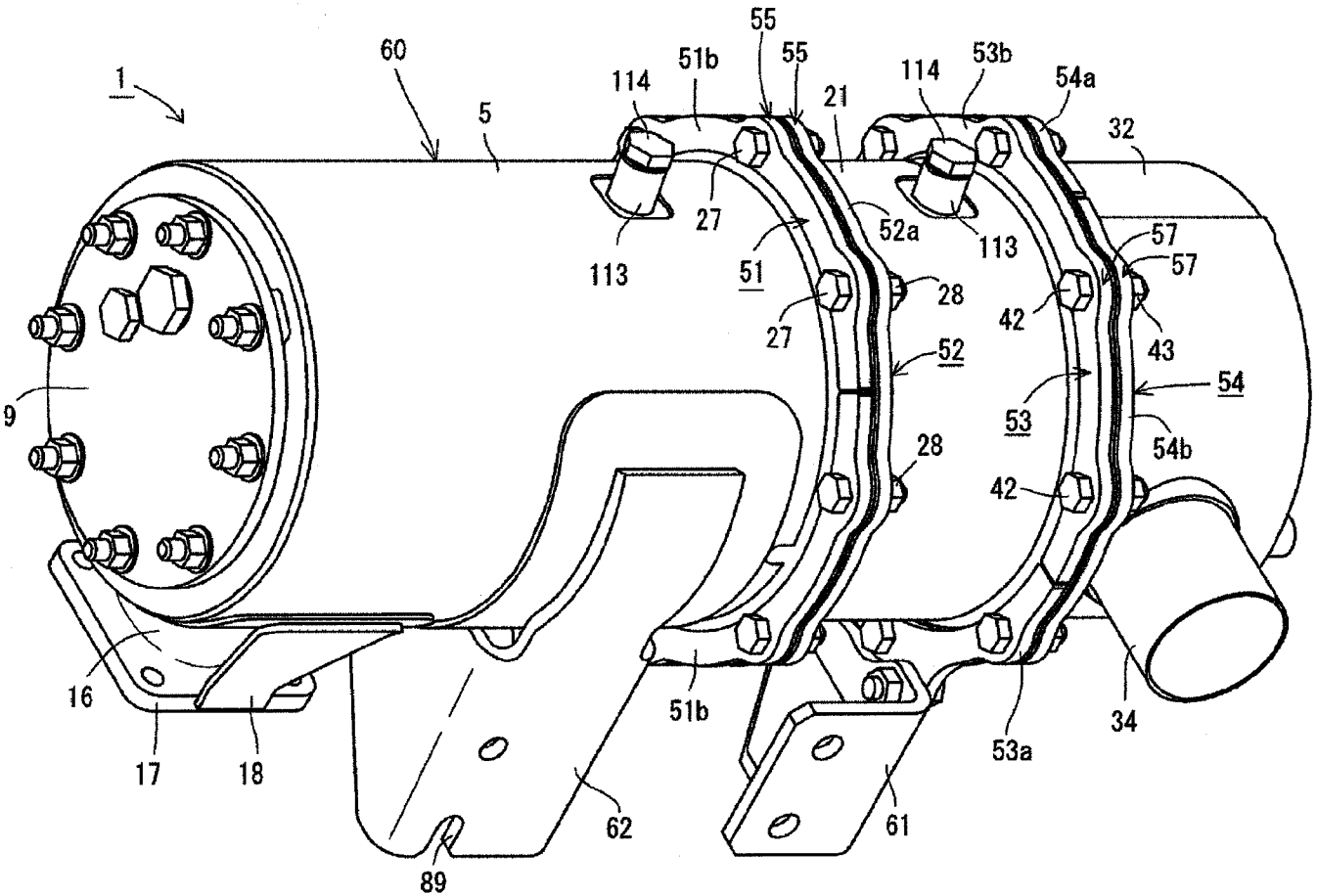
FIG. 2 is a perspective view of an outer appearance of the DPF.
Figure 3:
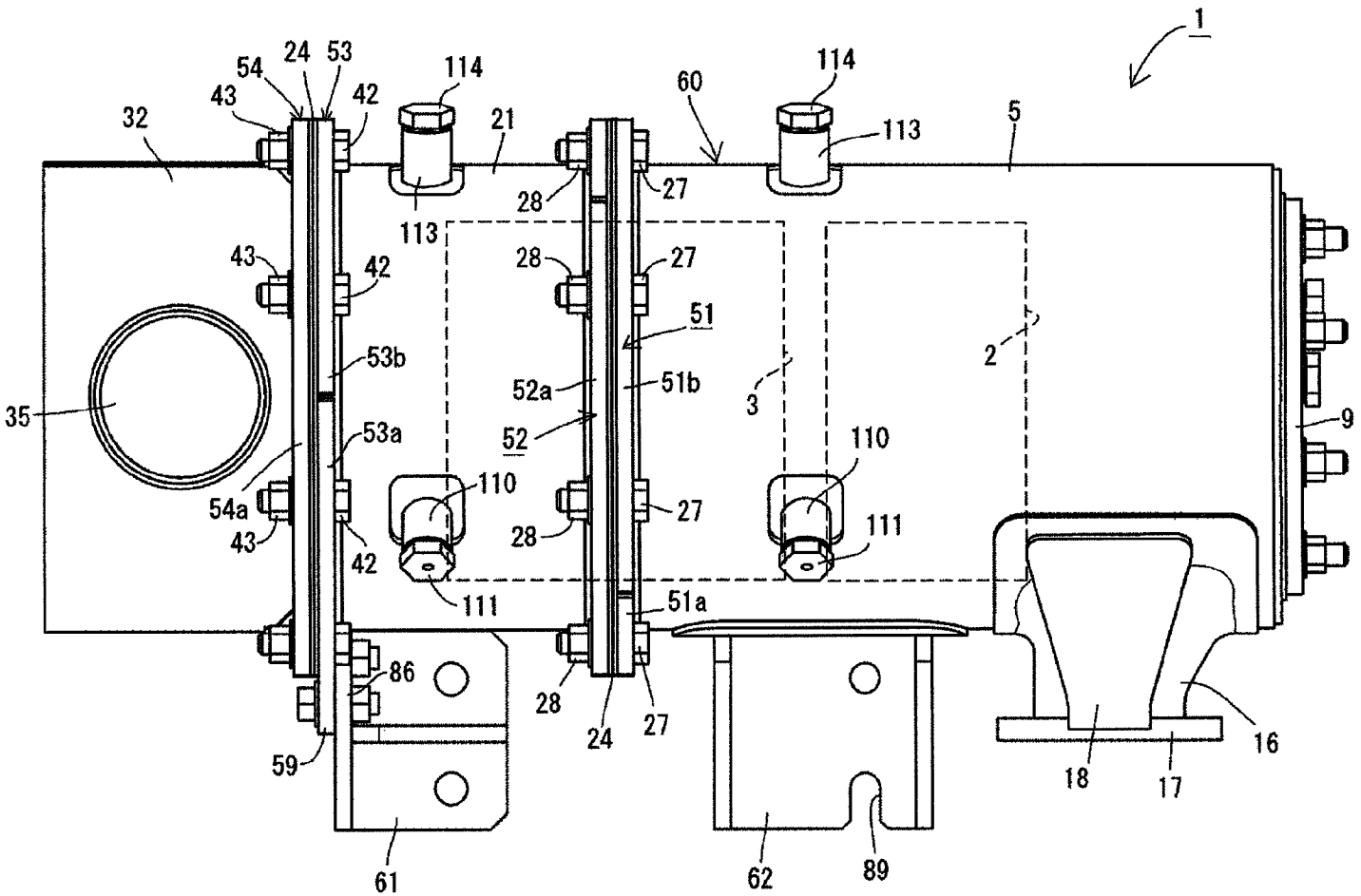
FIG. 3 is a plan view of the outer appearance of the DPF.
Figure 4:
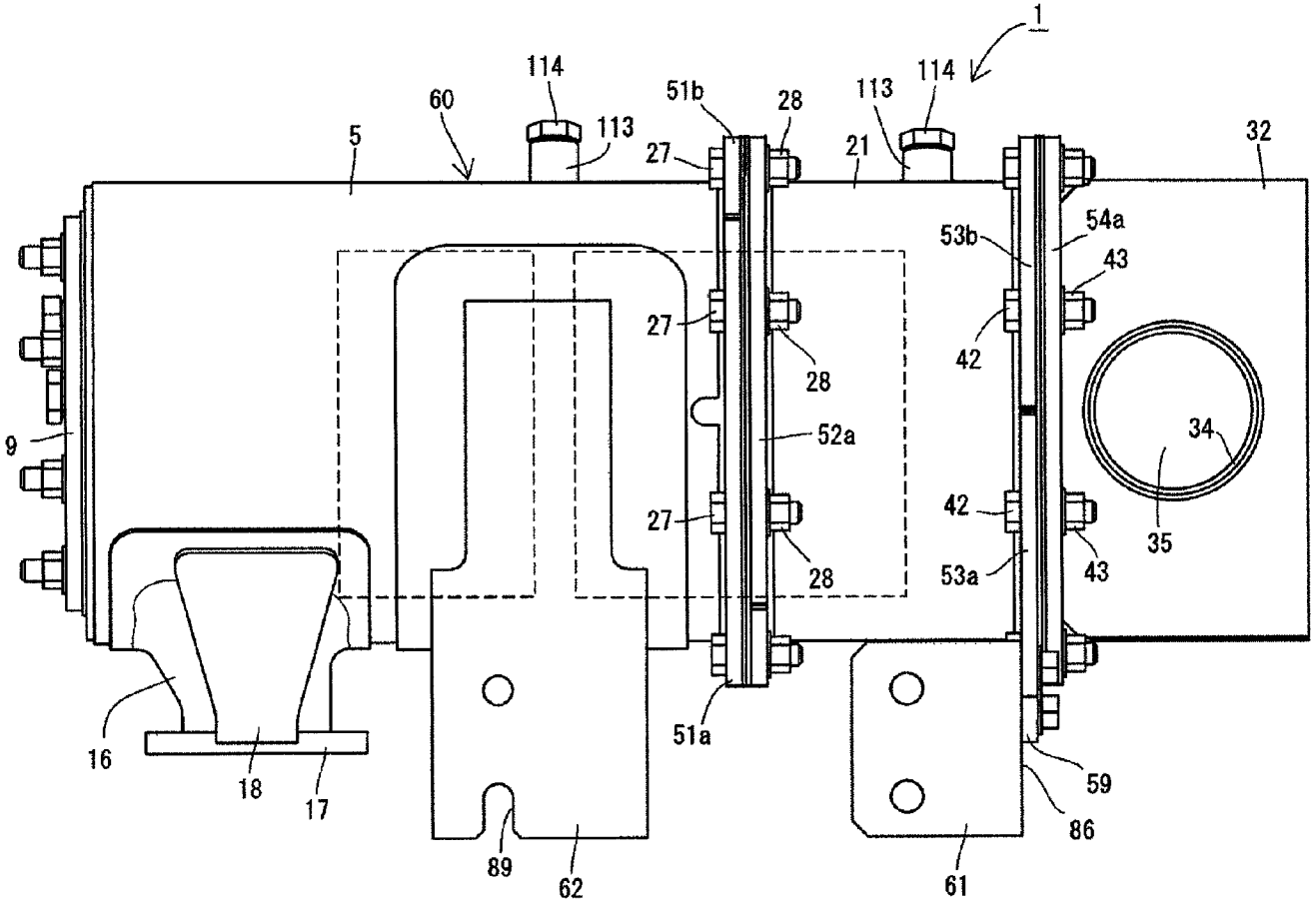
FIG. 4 is a bottom elevational view of the outer appearance of the DPF.
Figure 5:
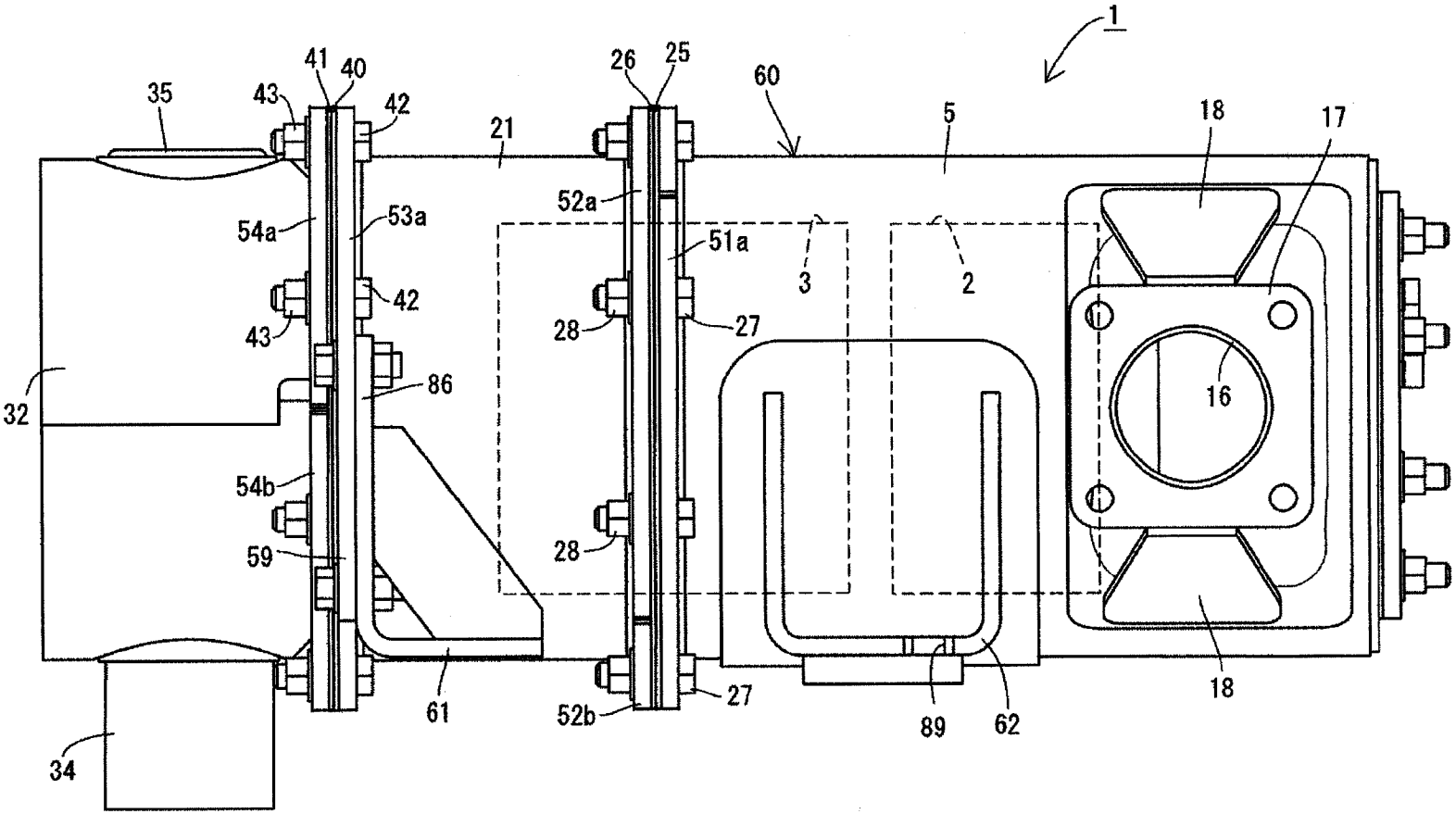
FIG. 5 is a front elevational view of the outer appearance of the DPF.
Figure 6:
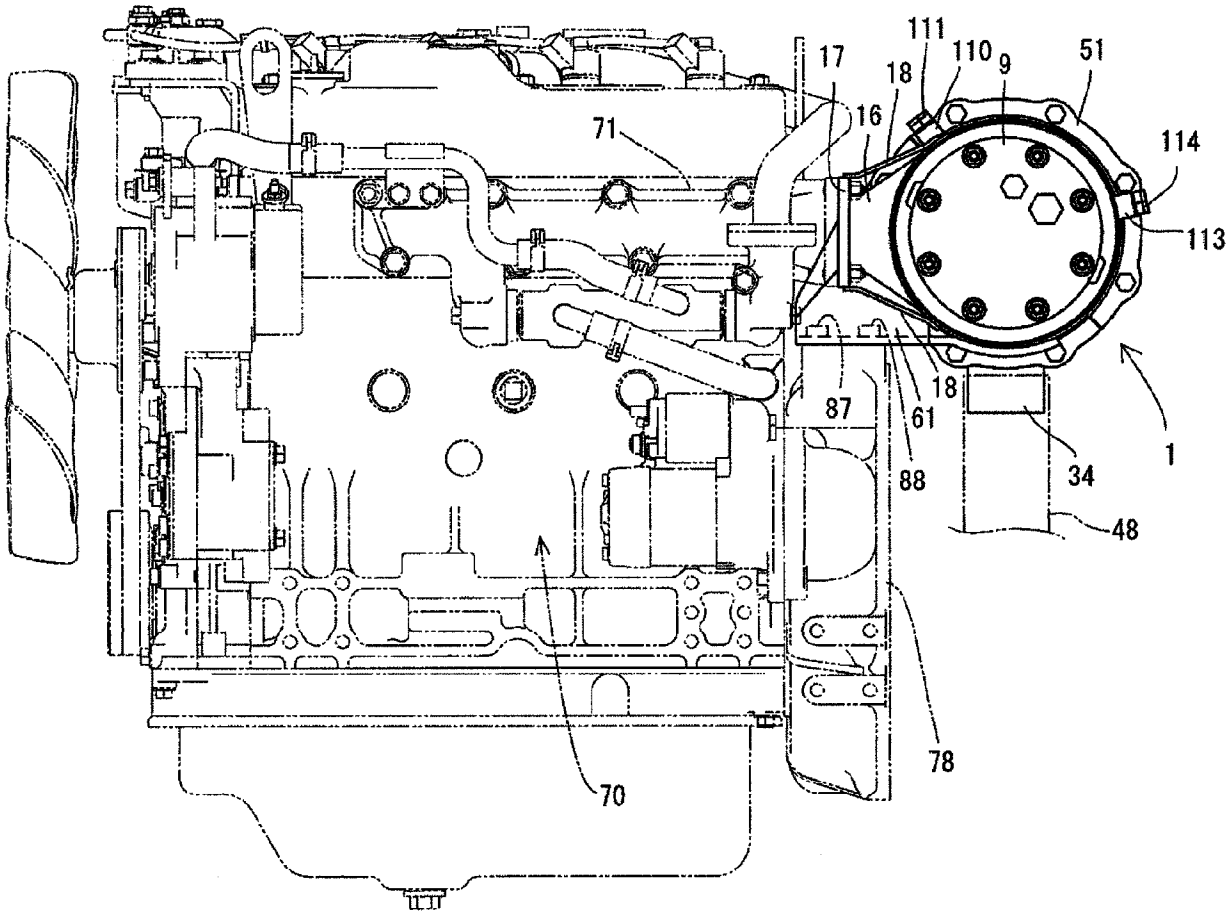
FIG. 6 is a side elevational view of the outer appearance of the DPF.
Figure 7:
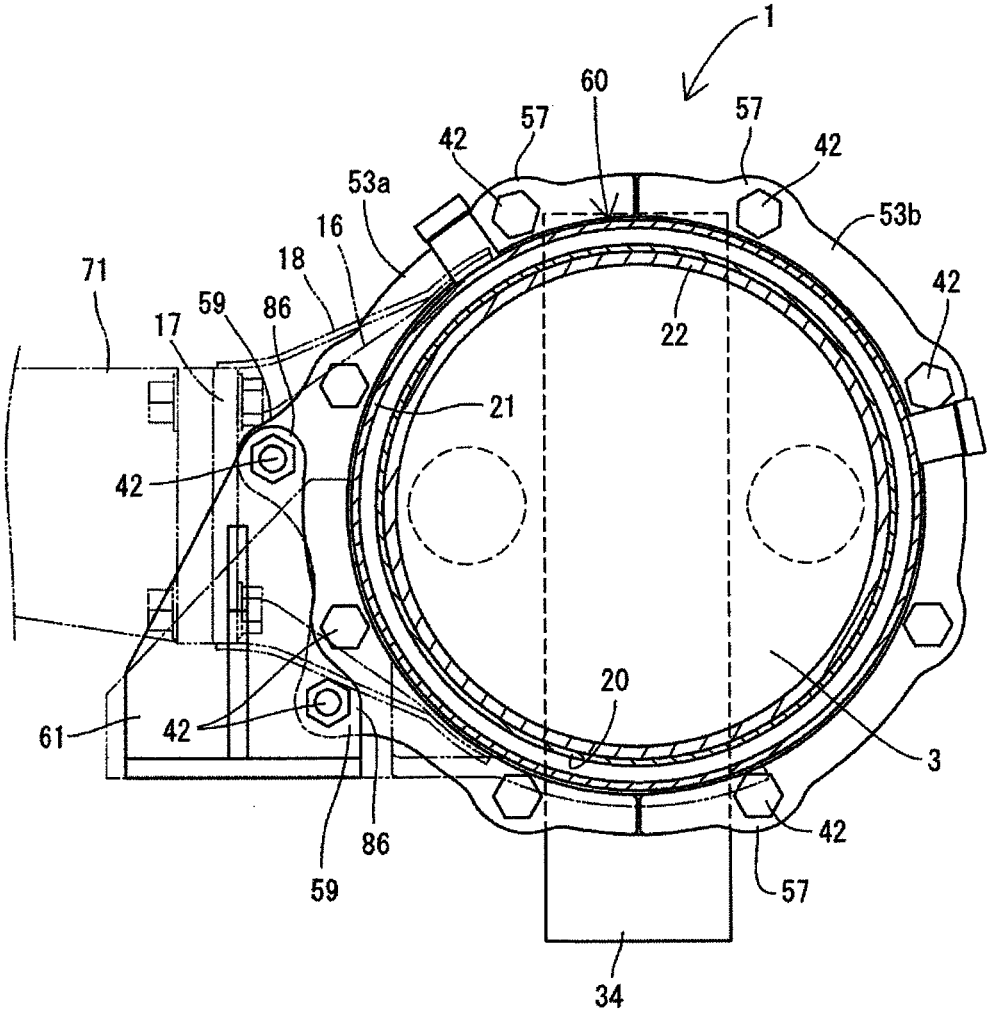
FIG. 7 is a cross sectional side view of an upstream side of the DPF.
Figure 13:
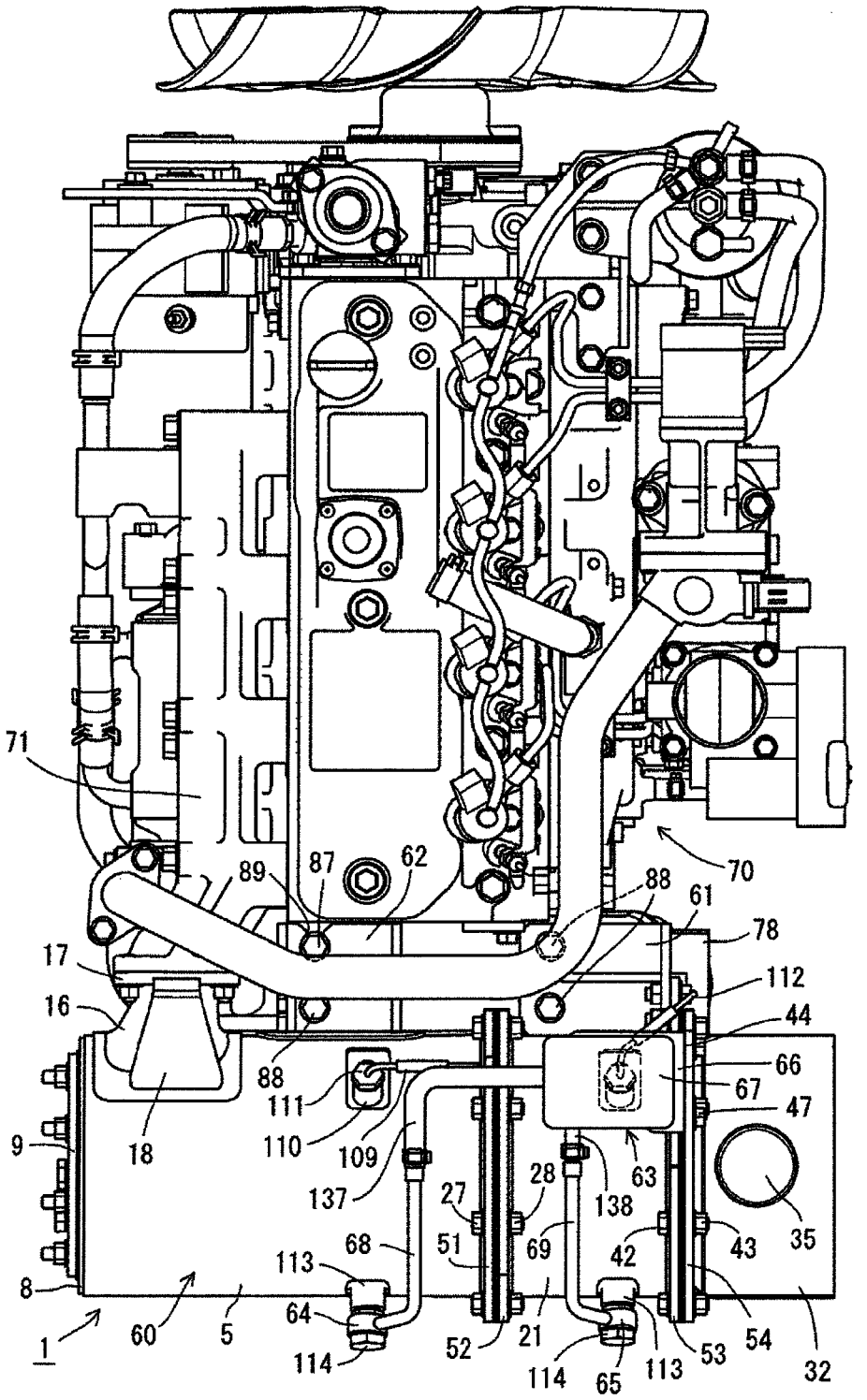
FIG. 13 is a plan view of a diesel engine which is provided with the DPF.
Figure 14:
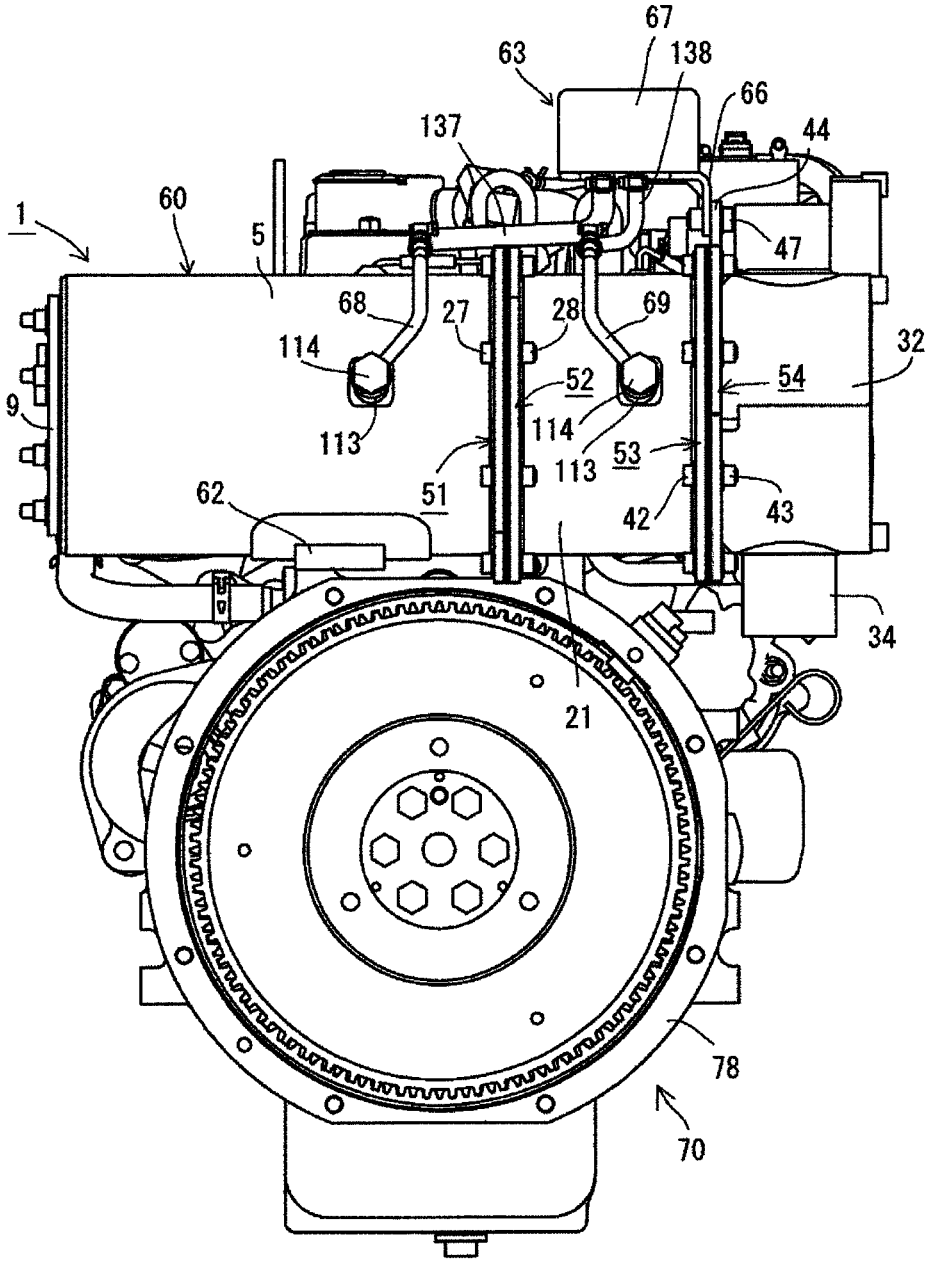
FIG. 14 is a back elevational view of the diesel engine which is provided with the DPF.

As shown in FIG. 1, FIG. 6 and FIG. 13, the DPF 1 serving as the exhaust gas purifying device is provided for collecting the particulate matter (PM) in the exhaust gas. The DPF 1 is structured as an approximately cylindrical shape which extends long in a lateral direction which intersects an output shaft (a crank shaft) of the diesel engine 70 in a plan view. The DPF 1 is arranged on a flywheel housing 78 of the diesel engine 70. Both left and right sides (one end side and the other end side in a moving direction of the exhaust gas) of the DPF 1 are provided with an exhaust gas inlet pipe 16 (an exhaust gas intake side), and an exhaust gas outlet pipe 34 (an exhaust gas discharge side) so as to be sorted to left and right sides of the diesel engine 70. The exhaust gas inlet pipe 16 in the exhaust gas intake side of the DPF 1 is detachably fastened by bolt to an exhaust manifold 71 of the diesel engine 70. A tail pipe 107 is connected to the exhaust gas outlet pipe 34 in the exhaust gas discharge side of the DPF 1.

As shown in FIG. 1 to FIG. 6, the DPF 1 is structured such that a diesel oxidation catalyst 2, for example, a platinum or the like and a soot filter 3 of a honeycomb structure are accommodated in series side by side in a DPF casing 60 made of a heat resisting metal material, via cylindrical inside cases 4 and 20. The DPF 1 is attached to a flywheel housing 78 via a flange side bracket leg 61 and a casing side bracket leg 62 serving as a support body. In this case, one end side of the flange side bracket leg 61 is detachably fastened by bolt to an outer peripheral side of the DPF casing 60 via a flange 26 mentioned later. One end side of the casing side bracket leg 62 is integrally fixed by welding to an outer peripheral surface of the DPF casing 60.

On the other hand, as shown in FIGS. 1 to 6 and FIG. 13, the other end side of the flange side bracket leg 61 is detachably fastened to an upper surface (a DPF attaching portion) of the flywheel housing 78 by two after attaching bolts 88. The other end side of the casing side bracket leg 62 is detachably fastened to the upper surface (the DPF attaching portion) of the flywheel housing 78 by a before attaching bolt 87 and the after attaching bolt 88. A notch hole 89 for engaging and inserting the before attaching bolt 87 is formed in the other end side of the casing side bracket leg 62.

In other words, in the case that the DPF 1 is assembled in the diesel engine 70, first of all, the before attaching bolt 87 is incompletely screwed to the upper surface of the flywheel housing 78. Further, a worker lifts up the DPF 1 by both hands, locks the casing side bracket leg 62 to the before attaching bolt 87 via the notch hole 89, and temporarily fastens the DPF 1 to the diesel engine 70. The worker can unlink both the hands from the DPF 1 in this state. Thereafter, an inlet flange body 17 is fastened to the exhaust manifold 71, and the exhaust gas inlet pipe 16 is firmly fixed to the exhaust manifold 71.

On the other hand, the flange side bracket leg 61 and the casing side bracket leg 62 are fastened to the upper surface of the flywheel housing 78 by three after attaching bolts 88. Further, the before attaching bolt 87 is completely fastened, and the DPF 1 is detachably firmly fixed to the upper surface of the flywheel housing 78. In this case, the DPF 1 can be detached in accordance with an inverse procedure to the above. As a result, the DPF 1 can be stably coupled and supported to a rear portion of the diesel engine 70, in an upper portion of the flywheel housing 78 which is a high rigidity member, by the bracket legs 61 and 62 and the exhaust manifold 71. Further, it is possible to execute an attaching and detaching work of the DPF 1 to and from the diesel engine 70 by only one worker.

The structure mentioned above, the exhaust gas of the diesel engine 70 flows into the diesel oxidation catalyst 2 side within the DPF casing 60 from the exhaust manifold 71 of the diesel engine 70, and moves from the diesel oxidation catalyst 2 to the soot filter 3 side so as to be purified. The particulate matter in the exhaust gas can not pass through a porous shaped partition wall between cells in the soot filter 3. In other words, the particulate matter in the exhaust gas is collected in the soot filter 3. Thereafter, the exhaust gas passing through the diesel oxidation catalyst 2 and the soot filter 3 is discharged to the tail pipe 107.

Since a temperature of the exhaust gas goes beyond a regenerable temperature (for example, about 300° C.) at a time when the exhaust gas passes through the diesel oxidation catalyst 2 and the soot filter 3, NO (a nitrogen monoxide) in the exhaust gas is oxidized into an unstable $NO_2$ (a nitrogen dioxide) on the basis of an action of the diesel oxidation catalyst 2. Further, the particulate matter which is picked up by the soot filter 3 is oxidized and removed by O (an oxygen) which is discharged at a time when $NO_2$ is returned to NO. In the case that the particulate matter is piled up in the soot filter 3, the particulate matter is oxidized and removed by retaining the temperature of the exhaust gas equal to or higher than the regenerable temperature. Therefore, a particulate matter collecting capacity of the soot filter 3 is recovered (the soot filter 3 is regenerated).

A description will be given of a structure which assembles the diesel oxidation catalyst 2 corresponding to one example of an exhaust gas purifying body (a filter) which purifies the exhaust gas discharged by the diesel engine 70, with reference to FIG. 1 and FIG. 9. The diesel oxidation catalyst 2 is provided within an approximately cylindrical catalyst inside case 4 made of a heat resisting metal material. The catalyst inside case 4 is provided within an approximately cylindrical catalyst outside case 5 made of a heat resisting metal material. In other words, the catalyst inside case 4 is fitted to an outer side of the diesel oxidation catalyst 2 via a mat shaped catalyst heat insulating material 6 made of a ceramic fiber. The catalyst heat insulating material 6 is pressure inserted between the diesel oxidation catalyst 2 and the catalyst inside case 4, thereby protecting the diesel oxidation catalyst 2.

Further, the catalyst outside case 5 is fitted to an outer side of the catalyst inside case 4 via a support body 7 constructed by an end face L-shaped thin plate. The catalyst outside case 5 is one of elements which construct the DPF casing 60 mentioned above. In this case, the diesel oxidation catalyst 2 is protected by the catalyst heat insulating material 6. A stress (a mechanical vibration and a deforming force) of the catalyst outside case 5 which is transmitted to the catalyst inside case 4 is lowered by the support body 7 constructed by the thin plate.

Figure 9:
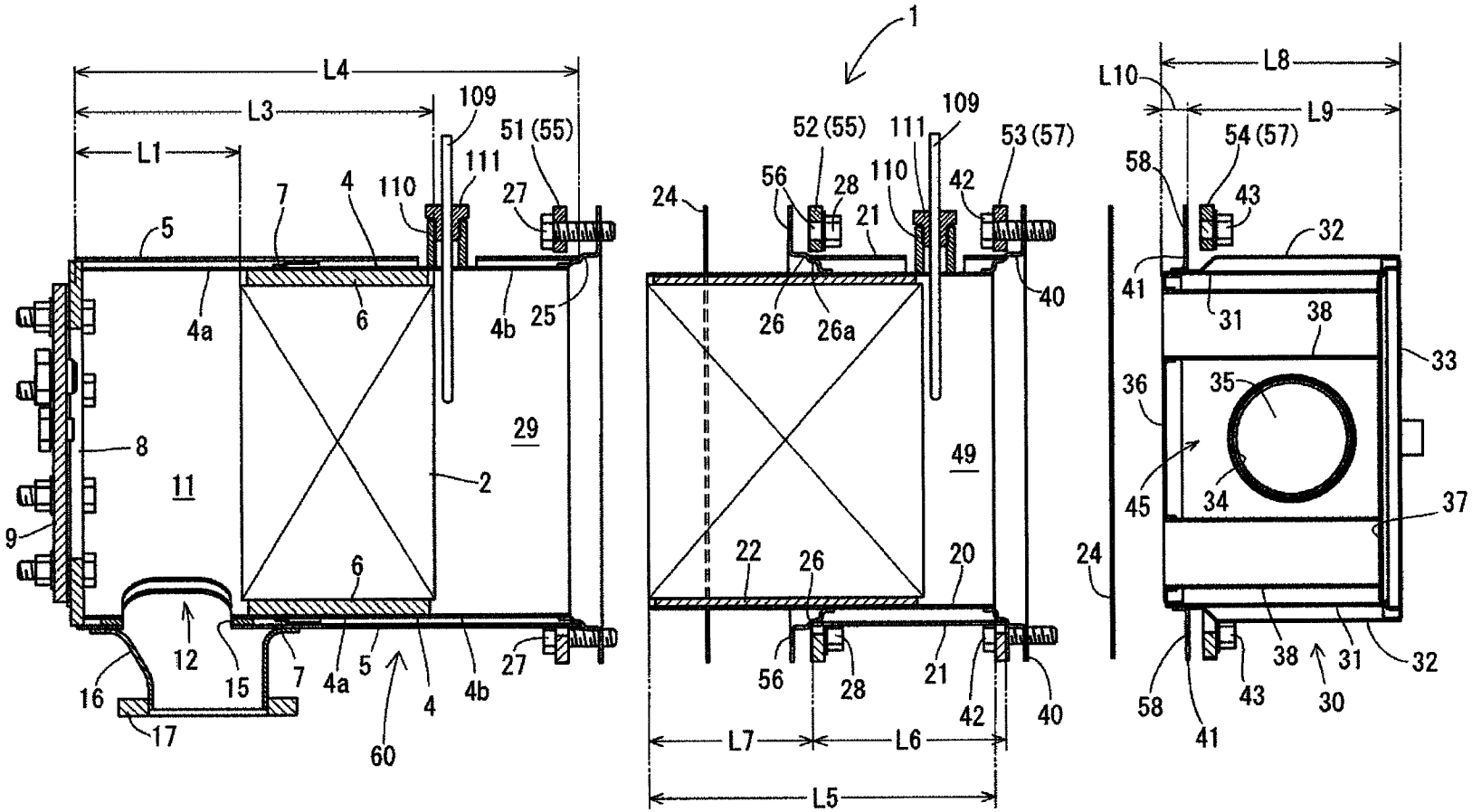
FIG. 9 is an exploded cross sectional explanatory view of the DPF.
Figure 10:
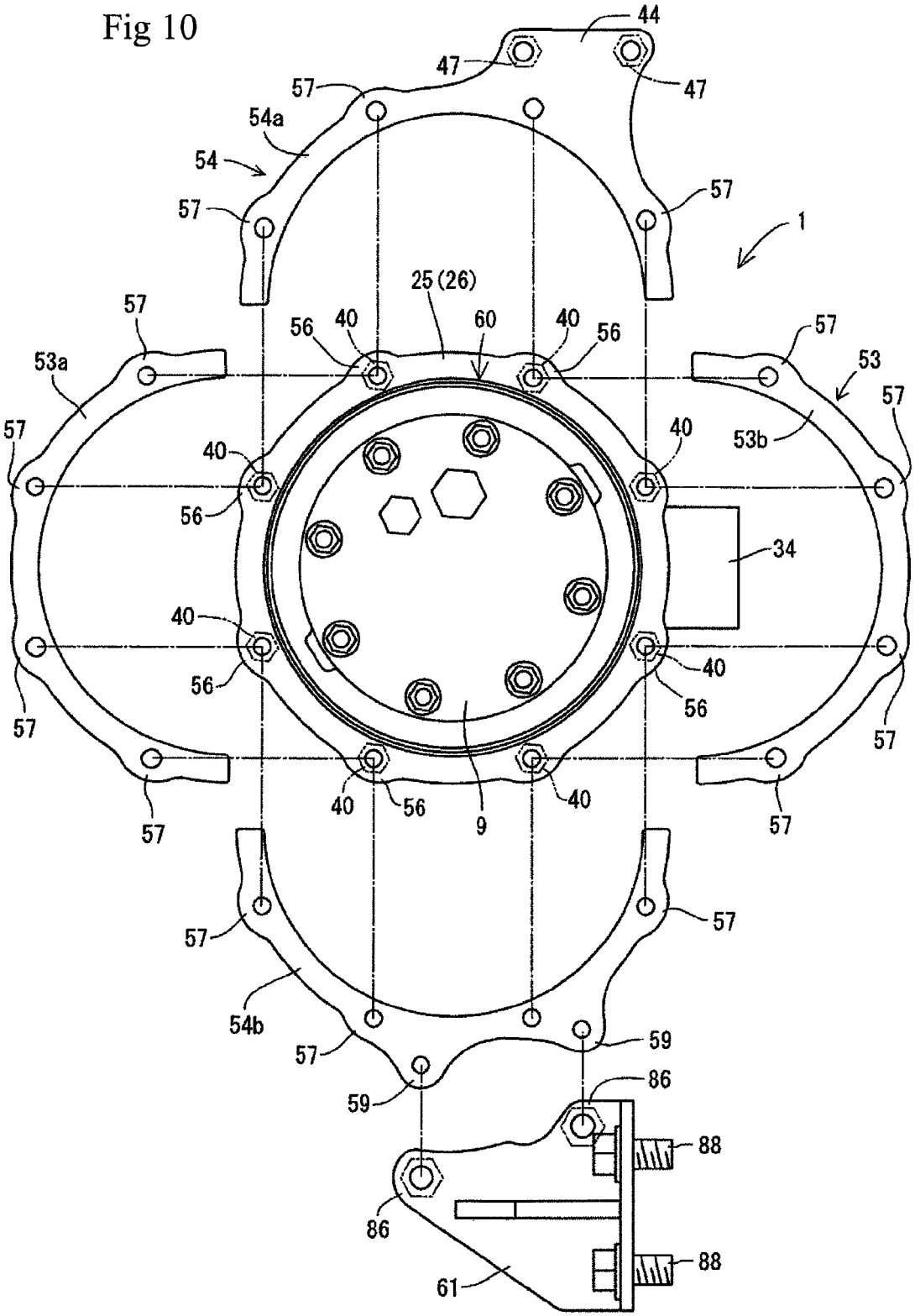
FIG. 10 is a separated side elevational view of a pinching flange (a semicircular arc body)

As shown in FIG. 1 and FIG. 9, a discoid side lid body 8 is firmly fixed to one side end portion of the catalyst inside case 4 and the catalyst outside case 5 by welding. An outer lid body 9 is fastened to an outer surface side of the side lid body 8 by a bolt and a nut. A gas inflow side end surface 2*a* of the diesel oxidation catalyst 2 and the side lid body 8 are spaced only at a fixed distance L1 (a gas inflow space 11). The exhaust gas inflow space 11 is formed between the gas inflow side, end surface 2*a* of the diesel oxidation catalyst 2 and the left lid body 8. An exhaust gas inflow port 12 which faces to the exhaust gas inflow space 11 is opened to the catalyst inside case 4 and the catalyst outside case 5. An occlusion ring body 15 is firmly fixed in a pinching manner between an opening edge of the catalyst inside case 4 and an opening edge of the catalyst outside case 5. Since a gap between the opening edge of the catalyst inside case 4 and the opening edge of the catalyst outside case 5 is closed by the occlusion ring body 15, it is possible to prevent the exhaust gas from flowing into between the catalyst inside case 4 and the catalyst outside case 5.

As shown in FIGS. 1 to 6 and FIG. 9, an exhaust gas inlet pipe 16 is arranged in an outer surface of the catalyst outside case 5 in which the exhaust gas inflow port 12 is formed. The inlet flange body 17 is fixed by welding to one opening end portion of the exhaust gas inlet pipe 16. The inlet flange body 17 is detachably fastened by bolt to the exhaust manifold 71 of the diesel engine 70. The one opening end portion of the exhaust gas inlet pipe 16 is communicated with the exhaust manifold 71. The other opening end portion of the exhaust gas inlet pipe 16 is welded to the outer surface of the catalyst outside case 5 in such a manner as to cover the exhaust gas inflow port 12 from an outer side. In this case, a pair of reinforcing bracket bodies 18 is fixed by welding between the outer surface of the catalyst outside case 5 and the side edge of the inlet flange body 17, and a coupling strength between the exhaust manifold 71 and the exhaust gas inlet pipe 16 is secured.

In the structure mentioned above, the exhaust gas of the diesel engine 70 enters into the exhaust gas inlet pipe 16 from the exhaust manifold 71, enters into the exhaust gas inflow space 11 from the exhaust gas inlet pipe 16 via the exhaust gas inflow port 12, and is supplied to the diesel oxidation catalyst 2 from the gas inflow side end surface 2*a* in a left side thereof. The nitrogen dioxide ($NO_2$) is generated on the basis of the oxidizing action of the diesel oxidation catalyst 2.

A description will be given of a structure which assembles the soot filter 3 corresponding to one example of the exhaust gas purifying body (the filter) which purifies the exhaust gas discharged by the diesel engine 70 with reference to FIG. 1 and FIG. 9. The soot filter 3 is provided within a filter inside case 20 which is made of a heat resisting metal material and is formed as an approximately cylindrical shape. The filter inside case 20 is provided within a filter outside case 21 which is made of a heat resisting metal material and is formed as an approximately cylindrical shape. In other words, the filter inside case 20 is fitted to an outer side of the soot filter 3 via a filter heat insulating material 22 which is made of a ceramic fiber and is formed as a mat shape. The filter outside case 21 is one of the elements which construct the DPF casing 60 mentioned above together with the catalyst outside case 5. In this case, the filter heat insulating material 22 is pressure inserted between the soot filter 3 and the filter inside case 20 so as to protect the soot filter 3.

As shown in FIG. 1 and FIG. 9, the catalyst inside case 4 which is formed as a cylindrical shape having a straight ridge line is constructed by an upstream side tube portion 4*a* which accommodates the diesel oxidation catalyst 2, and a downstream side tube portion 4*b* to which the filter inside case 20 mentioned below is inserted. In this case, the upstream side tube portion 4*a* and the downstream side tube portion 4*b* are cylinders having approximately the same diameter. Further, it is provided with a catalyst side junction flange 25 which is fixed by welding to an outer periphery of the catalyst inside case 4 and is formed as a thin plate ring shape, and a filter side junction flange 26 which is fixed by welding to an outer periphery of the filter inside case 20 and is formed as a thin plate ring shaped. The catalyst side junction flange 25 and the filter side junction flange 26 are formed as a donut shape in which a cross sectional end face is formed as an L-shaped form.

An inner peripheral side of the L-shaped cross sectional end face of the catalyst side junction flange 25 is fixed by welding to an end portion of the downstream side tube portion 4*b* of the catalyst inside case 4. An outer peripheral side of the L-shaped cross sectional end face of the catalyst side junction flange 25 is protruded toward an outer peripheral side (a radial direction) of the catalyst outside case 5. A step portion 25*a* is formed in a folded corner portion of the L-shaped cross sectional end face of the catalyst side junction flange 25. An end portion in a downstream side of the catalyst outside case 5 is fixed by welding to the step portion 25*a*.

On the other hand, an inner peripheral side of the L-shaped cross sectional end face of the filter side junction flange 26 is fixed by welding to a midway portion in an exhaust gas moving direction, in the outer periphery of the filter inside case 20. An outer peripheral side of the L-shaped cross sectional end face of the filter side junction flange 26 is protruded toward an outer peripheral side (a radial direction) of the filter outside case 21. A step portion 26*a* is formed in a folded corner portion of the L-shaped cross sectional end face of the filter side junction flange 26. An end portion in an upstream side of the filter outside case 21 is fixed by welding to the step portion 26*a*. In this case, the filter inside case 20 is formed as a cylindrical shape having a straight ridge line. The exhaust gas upstream side end portion and the downstream side end portion of the filter inside case 20 are cylinders having approximately the same diameter.

Further, an outer diameter of the diesel oxidation catalyst 2 is formed equal to an outer diameter of the soot filter 3. A thickness of the catalyst heat insulating material 6 is formed larger than a thickness of the filter heat insulating material 22. On the other hand, the catalyst inside case 4 and the filter inside case 20 are formed by a material having the same thickness. An outer diameter of the filter inside case 20 is formed smaller in comparison with an inner diameter of the downstream side tube portion 4*b* of the catalyst inside case 4. A downstream side gap 23 is formed between an inner peripheral surface of the catalyst inside case 4 and an outer peripheral surface of the filter inside case 20. The downstream side gap 23 is formed at a dimension (for example, 2 millimeter) which is larger than the thickness (for example, 1.5 millimeter) of each of the cases 4 and 20. For example, even if the cases 4 and 20 rusts or thermally deforms, it is possible to easily move the exhaust gas upstream side end portion of the filter inside case 20 into and out of the downstream side tube portion 4*b* of the catalyst inside case 4.

As shown in FIG. 1 to FIG. 5, FIG. 9 and FIG. 12, the catalyst side junction flange 25 and the filter side junction flange 26 are confronted via the gasket 24. The junction flanges 25 and 26 is pinched from both sides in the exhaust gas moving direction, by a pair of thick center pinching flanges 51 and 52 which surround the outer peripheral sides of the outside cases 5 and 21. The catalyst outside case 5 and the filter outside case 21 are detachably coupled by fastening the center pinching flanges 51 and 52 and pinching the junction flanges 25 and 26, by means of a bolt 27 and a nut 28.

Figure 12:
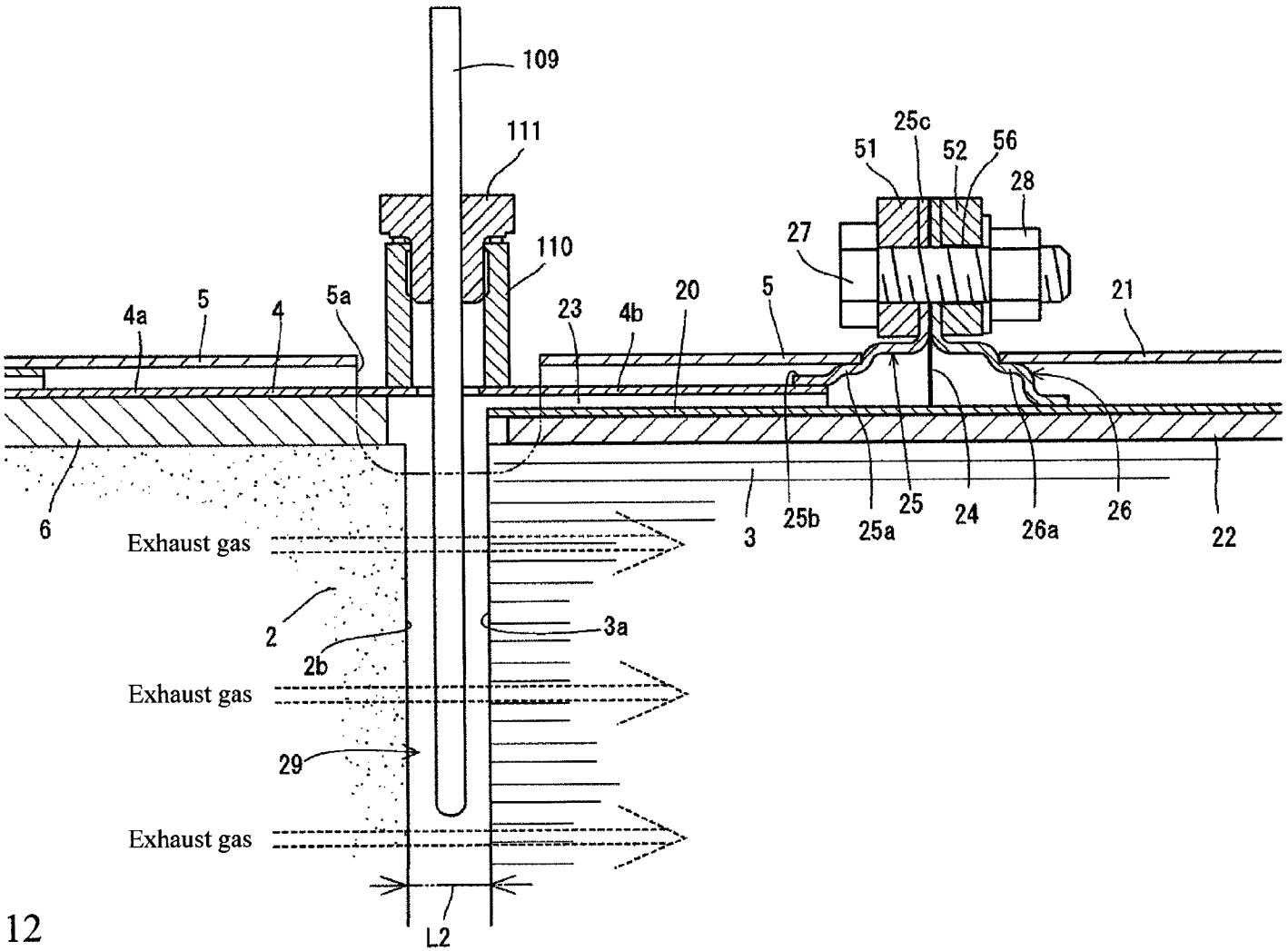
FIG. 12 is an enlarged cross sectional view showing an attaching portion of a sensor boss body for a gas temperature sensor.

As shown in FIG. 1 and FIG. 12, in a state in which the upstream side end portion of the filter outside case 21 is coupled to the downstream side end portion of the catalyst outside case 5 via the center pinching flanges 51 and 52 and the junction flanges 25 and 26, a catalyst downstream side space 29 is formed between the diesel oxidation catalyst 2 and the soot filter 3. In other words, the downstream side end portion of the diesel oxidation catalyst 2 and the upstream side end portion of the soot filter 3 (the filter inside case 20) are faced so as to be spaced at a sensor attaching distance L2.

As shown in FIG. 1 and FIG. 9, a cylinder length L4 in the exhaust gas moving direction of the catalyst outside case 5 is formed longer than a cylinder length L3 in the exhaust gas moving direction of the upstream side tube portion 4*a* in the catalyst inside case 4. A cylinder length L6 in the exhaust gas moving direction of the filter outside case 21 is formed shorter than a cylinder length L5 in the exhaust gas moving direction of the filter inside case 20. A length (L2+L3+L5) obtained by adding the sensor attaching distance L2 of the catalyst downstream side space 29, the cylinder length L3 of the upstream side tube portion 4*a* of the catalyst inside case 4, and the cylinder length L5 of the filter inside case 20 is structured such as to be approximately equal to a length (L4+L6) obtained by adding the cylinder length L4 of the catalyst outside case 5 and the cylinder length L6 of the filter outside case 21.

Further, the end portion in the upstream side of the filter inside case 20 protrudes from the end portion in the upstream side of the filter outside case 21 at a difference (L7≈L5−L6) between the lengths of the cases 20 and 21. Accordingly, in a state in which the filter outside case 21 is coupled to the catalyst outside case 5, the end portion in the upstream side of the filter inside case 20 is inserted to the downstream side of the catalyst outside case 5 (the downstream side tube portion 4*b* of the catalyst inside case 4), at the upstream side dimension L7 of the filter inside case 20 protruding out of the filter outside case 21. In other words, the upstream side of the filter inside case 20 is inserted into the downstream side tube portion 4*b* (the catalyst downstream side space 29) so as to be freely extracted.

In the structure mentioned above, the nitrogen dioxide ($NO_2$) which is created by the oxidizing action of the diesel oxidation catalyst 2 is supplied into the soot filter 3 from one side end face (an intake side end face) 3*a*. The particulate matter (PM) which is included in the exhaust gas of the diesel engine 70 is collected by the soot filter 3 and is continuously oxidized and removed by the nitrogen dioxide ($NO_2$). In addition to the removal of the particulate matter (PM) in the exhaust gas of the diesel engine 70, contents of the carbon oxide (CO) and the hydro carbon (HC) in the exhaust gas of the diesel engine 70 are reduced.

Figure 8:
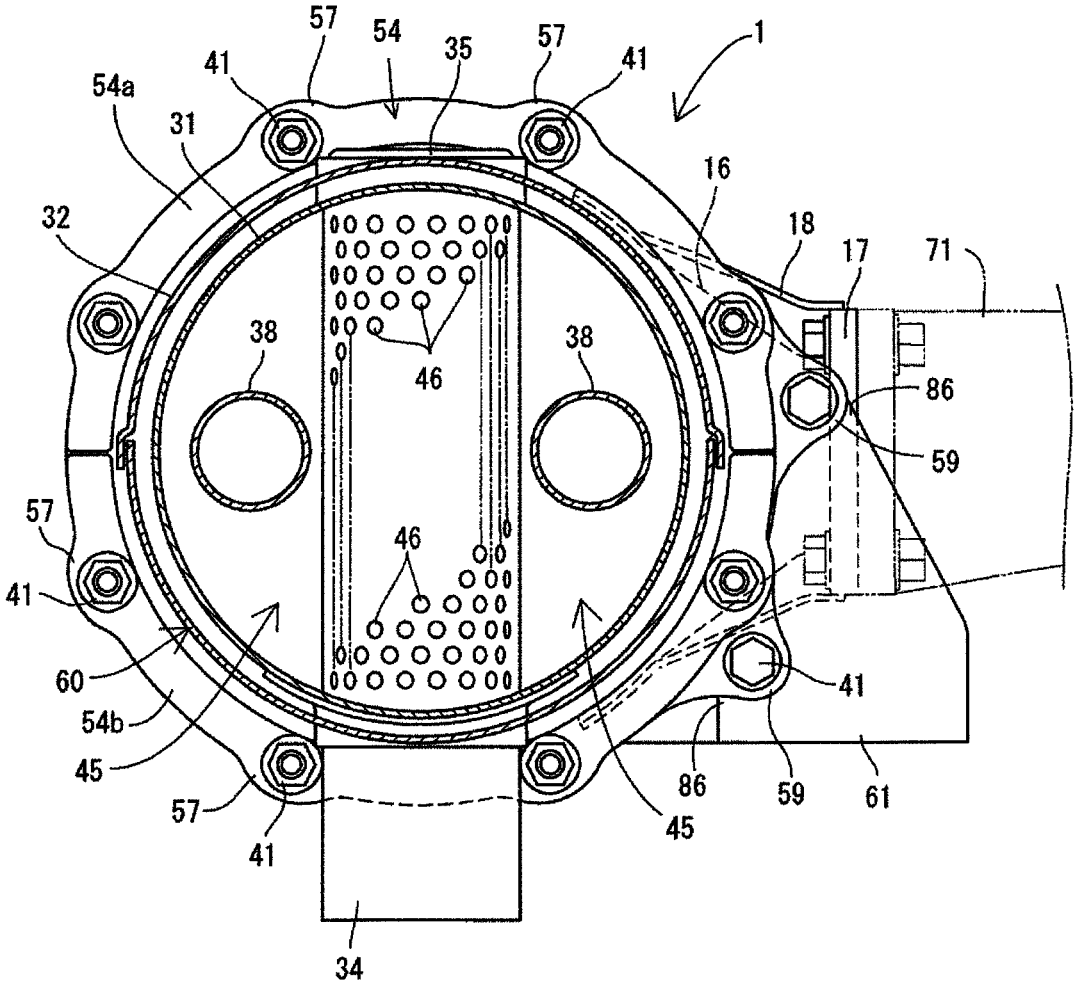
FIG. 8 is a cross sectional side view of a downstream side of the DPF.

As shown in FIG. 1, FIG. 8 and FIG. 9, a muffler 30 which attenuates an exhaust gas sound discharged by the diesel engine 70 has a sound absorbing inside case 31 which is made of a heat resisting metal material and is formed as an appropriately cylindrical shape, a sound absorbing outside case 32 which is made of a heat resisting metal material and is formed as an approximately cylindrical shape, and a discoid side lid body 33 which is firmly fixed by welding to a side end portion in a downstream side of the sound absorbing outside case 32. The sound absorbing inside case 31 is provided within the sound absorbing outside case 32. The sound absorbing outside case 32 constructs the DPF casing 60 mentioned above together with the catalyst outside case 5 and the filter outside case 21. In this case, a diameter of the cylindrical sound absorbing outside case 32 is approximately the same dimension as the diameter of the cylindrical catalyst outside case 5 or the diameter of the cylindrical filter outside case 21.

Discoid inner lid bodies 36 and 37 are firmly fixed by welding to both side end portions in an exhaust gas moving direction of the sound absorbing inside case 31. A pair of exhaust gas introduction pipes 38 are provided between the inner lid bodies 36 and 37. An upstream side end portion of each of the exhaust gas introduction pipes 38 passes through the upstream inner lid body 36. A downstream side end portion of each of the exhaust gas introduction pipes 38 is occluded by the downstream inner lid body 37. A plurality of communication holes 39 is formed in an intermediate portion of each of the exhaust gas introduction pipes 38. An expansion chamber 45 is communicated within each of the exhaust gas introduction pipes 38 via a communication hole 39. The expansion chamber 45 is formed in an inner portion of the sound absorbing inside case 31 (between the inner lid bodies 36 and 37).

The exhaust gas outlet pipe 34 arranged between the exhaust gas introduction pipes 38 is passed through the sound absorbing inside case 31 and the sound absorbing outside case 32. One end side of the exhaust gas outlet pipe 34 is occluded by the outlet lid body 35. A lot of exhaust holes 46 are provided in a whole of the exhaust gas outlet pipe 34 in an inner portion of the sound absorbing inside case 31. Each of the exhaust gas introduction pipes 38 is communicated with the exhaust gas outlet pipe 34 via a plurality of communication holes 39, the expansion chamber 45 and a lot of exhaust holes 46. A tail pipe 48 is connected to the other end side of the exhaust gas outlet pipe 34. In the structure mentioned above, the exhaust gas entering into both the exhaust gas introduction pipes 38 of the sound absorbing inside case 31 passes through the exhaust gas outlet pipe 34 via a plurality of communication holes 39, the expansion chamber 45 and a lot of exhaust holes 46, and is discharged out of the muffler 30 via the tail pipe 48.

As shown in FIG. 1 and FIG. 9, an inner diameter side of a filter outlet side junction flange 40 formed as a thin plate ring shape is fixed by welding to an end portion in a downstream side of the filter inside case 20. An outer diameter side of the filter outlet side junction flange 40 is protruded toward an outer peripheral side (a radially outside or a radial direction) of the filter outside case 21. An end portion in a downstream side of the filter outside case 21 is fixed by welding to an outer peripheral side (an end face L-shaped corner portion) of the filter outlet side junction flange 40. A sound absorbing side junction flange 41 which protrudes to an outer peripheral side (a radially outer side) of the sound absorbing outside case 32 and is formed as a thin plate shape is fixed by welding to an end portion in an upstream side of the sound absorbing inside case 31. In this case, an upstream side of the sound absorbing inside case 31 is protruded at a predetermined cylinder dimension L10 to an exhaust gas upstream side of the sound absorbing side junction flange 41. An end portion in an upstream side of the sound absorbing outside case 32 is fixed by welding to an outer peripheral surface of the sound absorbing inside case 31 in a downstream side of the sound absorbing side junction flange 41.

As shown in FIG. 1 and FIG. 7 to FIG. 10, the filter outlet side junction flange 40 and the sound absorbing side junction flange 41 are confronted via the gasket 24, and the junction flanges 40 and 41 are pinched from both sides on the exhaust gas moving direction by a pair of outlet pinching flanges 53 and 54 which surround an outer peripheral side of each of the outside cases 21 and 32 and are formed as a thick plate shape. The filter outside case 21 and the sound absorbing outside case 32 are detachably coupled by respectively fastening the outlet pinching flanges 53 and 54 to the junction flanges 40 and 41 by a bolt 42 and a nut 43.

As shown in FIG. 1 and FIG. 9, a cylinder length L9 in the exhaust gas moving direction of the sound absorbing outside case 32 is formed shorter than a cylinder length L8 in the exhaust gas moving direction of the sound absorbing inside case 31. An end portion in an upstream side of the sound absorbing inside case 31 is protruded at a difference (L10≈L8−L9) of the lengths of the cases 31 and 32 from an end portion (the junction flange 41) in the upstream side of the sound absorbing outside case 32. In other words, in a state in which the sound absorbing outside case 32 is coupled to the filter outside case 21, the upstream side end portion of the sound absorbing inside case 31 is inserted to a filter downstream side space 49 which is formed within a downstream side end portion (the filter outlet side junction flange 40) of the filter outside case 21, at the dimension L10 at which the end portion in the upstream side of the sound absorbing inside case 31 protrudes.

As shown in FIG. 1 and FIG. 7 to FIG. 10, a center pinching flange 51 (52) formed as a thick plate shape is constructed by semicircular arc bodies 51*a* and 51*b* (52*a* and 52*b*) which are divided into a plurality of (two in the embodiment) sections in a peripheral direction of the catalyst outside case 5 (the filter outside case 21). The semicircular arc bodies 51*a* and 51*b* (52*a* and 52*b*) according to the embodiment are formed as a circular arc shape (an approximately semicircular horseshoe shape). In a state in which the filter outside case 21 is coupled to the catalyst outside case 5, each of end portions of the semicircular arc bodies 51*a* and 51*b* comes into contact. In other words, it is structured such that an outer peripheral side of the catalyst outside case 5 (the filter outside case 21) is annularly surrounded by the semicircular arc bodies 51*a* and 51*b* (52*a* and 52*b*).

A plurality of bolt fastening portions 55 with through holes is provided in the center pinching flange 51 (52) at uniform intervals along the peripheral direction. In the embodiment, eight bolt fastening portions 55 are provided per one set of center pinching flanges 51. In the light of unit of each of the semicircular arc bodies 51*a* and 51*b* (52*a* and 52*b*), four bolt fastening portions 55 are provided at uniform intervals along the circumferential direction. On the other hand, a bolt hole 56 corresponding to each of the bolt fastening portions 55 of the center pinching flange 51 (52) is formed in a penetrating manner in the catalyst side junction flange 25 and the filter side junction flange 26.

At a time of coupling the catalyst outside case 5 and the filter outside case 21, an outer peripheral side of the catalyst outside case 5 is surrounded by both the semicircular arc bodies 51*a* and 51*b*, an outer peripheral side of the filter outside case 21 is surrounded by both the semicircular arc bodies 52*a* and 52*b* in the filter side, and the catalyst side junction flange 25 and the filter side junction flange 26 which pinch the gasket 24 are pinched from both sides in the exhaust gas moving direction by these semicircular arc body groups (the center pinching flanges 51 and 52).

In the state mentioned above, a bolt 27 is inserted to the bolt fastening portion 55 of the center pinching flanges 51 and 52 in both sides, and the bolt hole 56 of both the junction flanges 25 and 26 so as to be fastened by a nut 28. As a result, both the junction flanges 25 and 26 are pinched and fixed by both the center pinching flanges 51 and 52, and a coupling between the catalyst outside case 5 and the filter outside case 21 is completed. In this case, the confronting portion between the end portions of the semicircular arc bodies 51*a* and 51*b* in the catalyst side and the semicircular arc bodies 52*a* and 52*b* in the filter side are structured such as to be positioned so as to be shifted its phase at 72 degree from each other.

As shown in FIG. 1 and FIG. 7 to FIG. 10, the outlet pinching flange 53 (54) formed as the thick plate shape is constructed by a plurality of (two in the embodiment) semicircular arc bodies 53*a* and 53*b* (54*a* and 54*b*) which is divided in the peripheral direction of the filter outside case 21 (the sound absorbing outside case 32). The semicircular arc bodies 53*a* and 53*b* (54*a* and 54*b*) according to the embodiment basically have the same aspect as the semicircular arc bodies 51*a* and 51*b* (52*a* and 52*b*) of the center pinching flange 51 (52). A plurality of bolt fastening portions 57 with through holes is provided in the outlet pinching flange 53 (54) at uniform intervals along the peripheral direction. On the other hand, a bolt hole 58 corresponding to each of the bolt fastening portions 57 of the outlet pinching flange 53 (54) is formed in a penetrating manner in the filter outlet side junction flange 40 and the sound absorbing side junction flange 41.

At a time of coupling the filter outside case 21 and the sound absorbing outside case 32, the outer peripheral side of the filter outside case 21 is surrounded by both the semicircular arc bodies 53*a* and 53*b* in the filter outlet side, the outer peripheral side of the sound absorbing outside case 32 is surrounded by both the semicircular arc bodies 54*a* and 54*b* in the sound absorbing side, and the filter outlet side junction flange 40 and the sound absorbing side junction flange 41 which pinch the gasket 24 are pinched from both sides in the exhaust gas moving direction by these semicircular arc body groups (the outlet pinching flanges 53 and 54).

In the state mentioned above, a bolt 42 is inserted to the bolt fastening portion 57 of the outlet pinching flanges 53 and 54 in both sides, and the bolt holes 58 of both the junction flanges 40 and 41 so as to be fastened by a nut 43. As a result, both the junction flanges 40 and 41 are pinched and fixed by both the outlet pinching flanges 53 and 54, and a coupling between the filter outside case 21 and the sound absorbing outside case 32 is completed. In this case, the confronting portion between the end portions of the semicircular arc bodies 53*a* and 53*b* in the filter outlet side and the semicircular arc bodies 54*a* and 54*b* in the sound absorbing side are structured such as to be positioned so as to be shifted its phase at 72 degree from each other.

As shown in FIG. 1 and FIG. 7 to FIG. 10, the left bracket leg 61 which serves as a support body supporting the DPF casing 60 (the outside cases 5, 21 and 32) to the diesel engine 70 is attached at least to one of the pinching flanges 51 to 54. In the embodiment, a support body fastening portion 59 with a through hole is integrally formed in one of the semicircular arc body 53*a* in the outlet pinching flange 53 in the filter outlets side, at two positions in such a manner as to be positioned between the adjacent bolt fastening portions 57. On the other hand, an attaching boss portion 86 corresponding to the support body fastening portion 59 mentioned above is integrally formed in the left bracket leg 61.

In the structure mentioned above, the left bracket leg 61 is detachably fixed to the outlet pinching flange 53 in the filter outlet side, by fastening by bolt the attaching boss portion 86 of the left bracket leg 61 to the support body fastening portion 59 of one of the semicircular arc body 53*a* existing in the filter outlet side. One end side of the right bracket leg 62 is fixed by welding to the outer peripheral side of the DPF casing 60 (the catalyst outside case 5), and the other end sides of both the left and right bracket legs 61 and 62 are fastened by bolt to the DPF attaching portion 80 formed on an upper surface of the flywheel housing 78, in the same manner as mentioned above. As a result, the DPF 1 is stably coupled to and supported by the upper portion of the flywheel housing 78 which is a high rigidity member, by both the left and right bracket legs 61 and 62 and an exhaust gas discharge pipe 103 of a turbine case 101.

As shown in FIG. 1 and FIG. 7 to FIG. 10, it has a gas purifying body (the diesel oxidation catalyst 2 and the soot filter 3) which purifies the exhaust gas discharged by the engine 70, the inside cases 4, 20 and 31 which have the diesel oxidation catalyst 2 and the soot filter 3 built-in, and the outside cases 5, 21 and 32 which have the inside cases 4, 20 and 31 built-in. Further, the inside cases 4, 20 and 31 is coupled to the outside cases 5, 21 and 32 via the junction flanges 25, 26, 40 and 41 which protrude to the outer peripheral side of the outside cases 5, 21 and 32. A plurality of outside cases 5, 21 and 32 is coupled by preparing plural sets of combinations of the gas purifying body (the diesel oxidation catalyst 2 and the soot filter 3), the inside cases 4, 20 and 31 and the outside cases 5, 21 and 32, and pinching and fixing the junction flanges 25 and 26 (40 and 41) by a pair of pinching flanges 51 and 52 (53 and 54).

Accordingly, it is possible to pinch the adjacent junction flanges 25 and 26 (40 and 41) from both sides by the pinching flanges 51 and 52 (53 and 54) so as to bring into pressure contact (closely attach). Further, since the pinching flanges 51 to 54 are structured as the separate bodies without being welded to the outside cases 5, 21 and 32, there is no risk that a problem of a stress concentration and a strain caused by the welding is generated, in the relation between the pinching flanges 51 to 54 and the outside cases 5, 21 and 32. Accordingly, it is possible to apply an approximately uniform pressure contact force to a whole of the flanges 25 and 26 (40 and 41), and it is possible to maintain a surface pressure of a seal surface (the pinching surface) of the pinching flanges 51 to 54. As a result, it is possible to securely prevent an exhaust gas leakage from between the junction flanges 25 and 26 (40 and 41).

As shown in FIG. 1 and FIG. 7 to FIG. 10, each of the pinching flanges 51 to 54 is constructed by the horseshoe shaped semicircular arc bodies 51*a* and 51*b* (52*a*, 52*b*, 53*a*, 53*b*, 54*a* and 54*b*) which are divided into a plurality of sections in the peripheral direction of the outside cases 5, 21 and 32, and is structured such as to surround the outer peripheral side of the outside cases 5, 21 and 32 by a plurality of semicircular arc bodies 51*a* and 51*b* (52*a*, 52*b*, 53*a*, 53*b*, 54*a* and 54*b*). Accordingly, although they are the pinching flanges 51 to 54 constructed by a plurality of semicircular arc bodies 51*a* and 51*b* (52*a*, 52*b*, 53*a*, 53*b*, 54*a* and 54*b*), they come to the same assembled state as the integral structure. Accordingly, it is easily to assemble the pinching flanges 51 to 54 in comparison with the ring shaped structure, and it is possible to improve an assembling workability. Further, it is possible to construct the DPF 1 having a high sealing property, while suppressing a process cost and an assembly cost.

Figure 11:
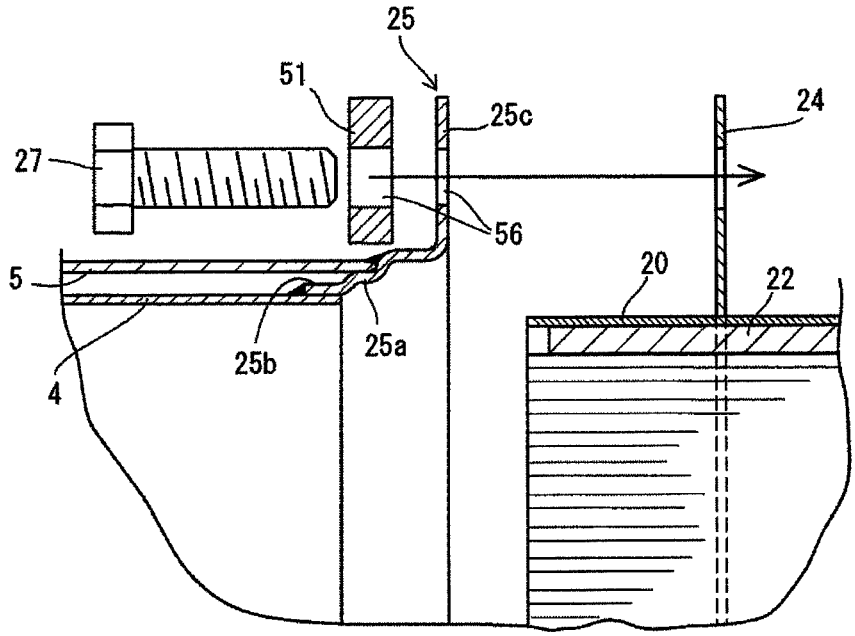
FIG. 11 is an enlarged cross sectional view of a catalyst side junction flange.

Next, a description will be given of a detailed structure of the junction flanges 25, 26 and 40 with reference to FIG. 11. Since the junction flanges 25, 26 and 40 basically have all the same structure, a description will be given of the catalyst side junction flange 25 which is fixed by welding to the catalyst inside case 4 and the catalyst outside case 5 as a representative example. FIG. 11 shows an enlarged side cross sectional view of the catalyst side junction flange 25 in the embodiment. As shown in FIG. 11, the catalyst side junction flange 25 has a step portion 25*a* in which a cross sectional end face is folded as a step shape in an intermediate of an L-shaped form. A downstream side end portion of the catalyst outside case 5 is fitted to the step portion 25*a*, and the step portion 25*a* is fixed by welding to the downstream side end portion of the catalyst outside case 5.

On the other hand, an L-shaped inner diameter side end portion 25*b* of the catalyst side junction flange 25 is extended in an extending direction (the exhaust gas moving direction) of the catalyst inside case 4 (the catalyst outside case 5). The inner diameter side end portion 25*b* is fitted to the downstream side end portion of the catalyst inside case 4, and the inner diameter side end portion 25*b* is fixed by welding to the catalyst inside case 4. On the other hand, an L-shaped outer diameter side end portion 25*c* of the catalyst side junction flange 25 is extended toward a radial direction (a vertical direction) from an outer periphery of the catalyst outside case 5. A high rigidity of the catalyst side junction flange 25 is secured by forming the L-shaped form in the cross sectional end face of the catalyst side junction flange 25 and the step portion 25*a*.

In this case, the bolt 27 is passed through the pinching flanges 51 and 52 and the junction flanges 25 and 26 via the respective bolt holes 56, and is screw attached by the nut 28, and the pinching flanges 51 and 52 and the junction flanges 25 and 26 are fastened, whereby the outer diameter side end portion 25*c* of the catalyst side junction flange 25 is pinched by the pinching flanges 51 and 52, in the same manner as mentioned above.

Next, a description will be given of an upstream side gas temperature sensor 109 (a downstream side gas temperature sensor 112) which is provided in the DPF 1, as shown in FIG. 1 and FIG. 12. One end side of a cylindrical sensor boss body 110 is fixed by welding to the outer peripheral surface of the catalyst inside case 4, between the upstream side tube portion 4*a* and the downstream side tube portion 4*b* of the catalyst inside case 4. The other end side of the sensor boss body 110 is extended in a radial direction from a sensor attaching opening 5*a* of the catalyst outside case 5 toward the outer side of the case 5. A sensor attaching bolt 111 is attached by screw to the other end side of the sensor boss body 110. For example, a thermistor type upstream side gas temperature sensor 109 is passed through the sensor attaching bolt 111, and the upstream side gas temperature sensor 109 is supported to the sensor boss body 110 via the sensor attaching bolt 111. A detecting portion of the upstream side gas temperature sensor 109 is protruded into the catalyst downstream side space 29.

In the structure mentioned above, when the exhaust gas is discharged from the gas outflow side end face 2*b* of the diesel oxidation catalyst 2, the exhaust gas temperature is detected by the upstream side gas temperature sensor 109. In this case, in the same manner as mentioned above, as shown in FIG. 1, for example, the thermistor type downstream side gas temperature sensor 112 is attached to the sensor boss body 110 via the sensor attaching bolt 111, and the temperature of the exhaust gas in the other side end face (the discharged side end face) 3*b* of the soot filter 3 is detected by the downstream side gas temperature sensor 112.

Next, a description will be given of an attaching structure of a differential pressure sensor 63 which is provided in the DPF 1, with reference to FIG. 10 and FIG. 13 to FIG. 20. As shown in FIG. 13, the differential pressure sensor 63 is provided as the exhaust gas pressure sensor. The differential pressure sensor 63 is provided for detecting a pressure difference of the exhaust gas between the upstream side and the downstream side with reference to the soot filter 3 within the DPF 1. It is structured such that a piled-up amount of the particulate matter in the soot filter 3 is converted on the basis of the pressure difference, and a clogged state within the DPF 1 can be comprehended. In other words, it is structured such that a regeneration control of the soot filter 3 can be automatically executed, for example, by actuating an accelerator control means or an intake throttle control means which are not illustrated, on the basis of the pressure difference of the exhaust gas which is detected by the differential pressure sensor 63.

As shown in FIG. 13 to FIG. 19, a sensor bracket 66 is fastened by bolt to the inlet pinching flange 54 in the sound absorbing side, and the sensor bracket 66 is arranged in an upper surface side of the DPF casing 60. A detection main body 67 of the differential pressure sensor 63 is attached to the sensor bracket 66. A upstream side pipe joint body 64 and a downstream side pipe joint body 65 are respectively connected to the detection main body 67 of the differential pressure sensor 63 via an upstream side sensor piping 68 and a downstream side sensor piping 69. A sensor boss body 113 is arranged, in the same manner as the sensor boss body 110, in the DPF casing 60. The upstream side pipe joint body 64 (the downstream side pipe joint body 65) is fastened to the sensor boss body 113 by a pipe joint bolt 114.

As shown in FIG. 10, FIG. 13 to FIG. 19, the sensor support portion 44 is integrally formed in a part of the inlet pinching flange 54 in the sound absorbing side, and the sensor bracket 66 is fastened to the sensor support portion 44 by a bolt 47. The inlet pinching flange 54 in the sound absorbing side (the flange body for attaching the exhaust gas purifying case) is detachably fastened to the outlet pinching flange 53 in the filter outlet side (the flange body for attaching the exhaust gas pressure sensor) via a bolt 42 and a nut 43. In other words, the sensor bracket 66 for attaching the exhaust gas pressure sensor is detachably provided in the sensor support portion 44, and the differential pressure sensor (the exhaust gas pressure sensor) 63 is arranged in the outer side surface of the filter outside case (the exhaust gas purifying case) 21.

Figure 15:
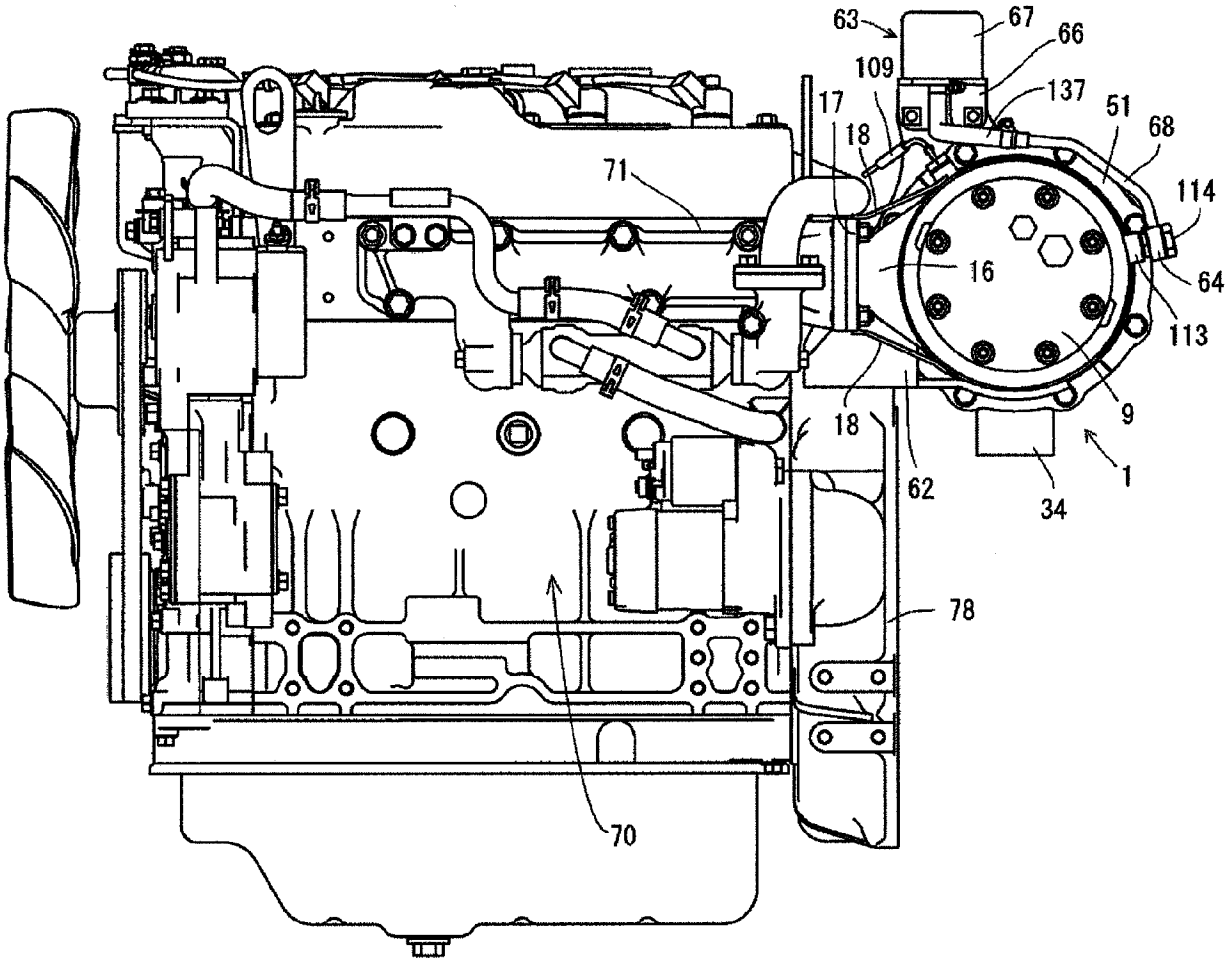
FIG. 15 is a left side view of the diesel engine which is provided with the DPF.
Figure 16:
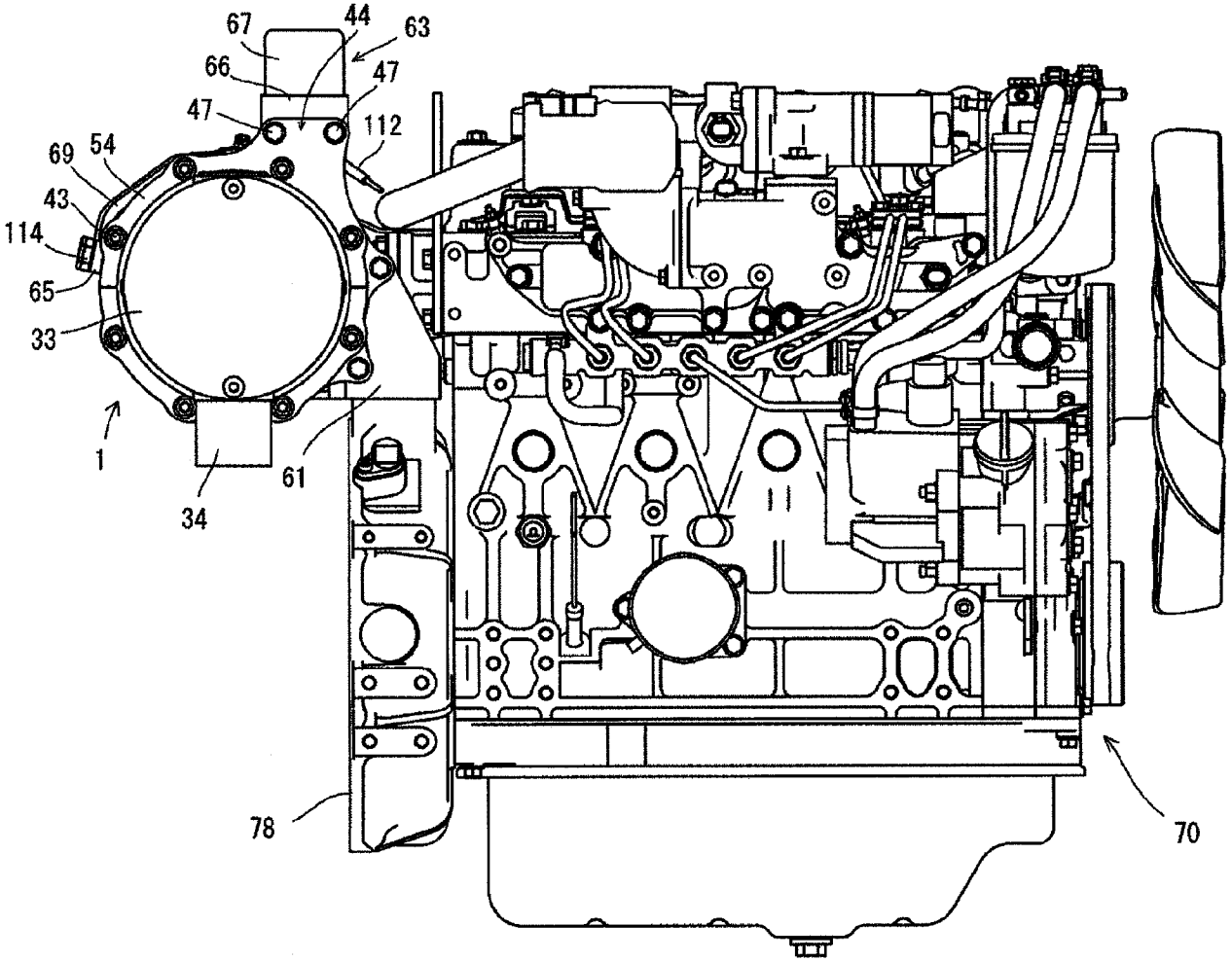
FIG. 16 is a right side view of the diesel engine which is provided with the DPF.
Figure 17:
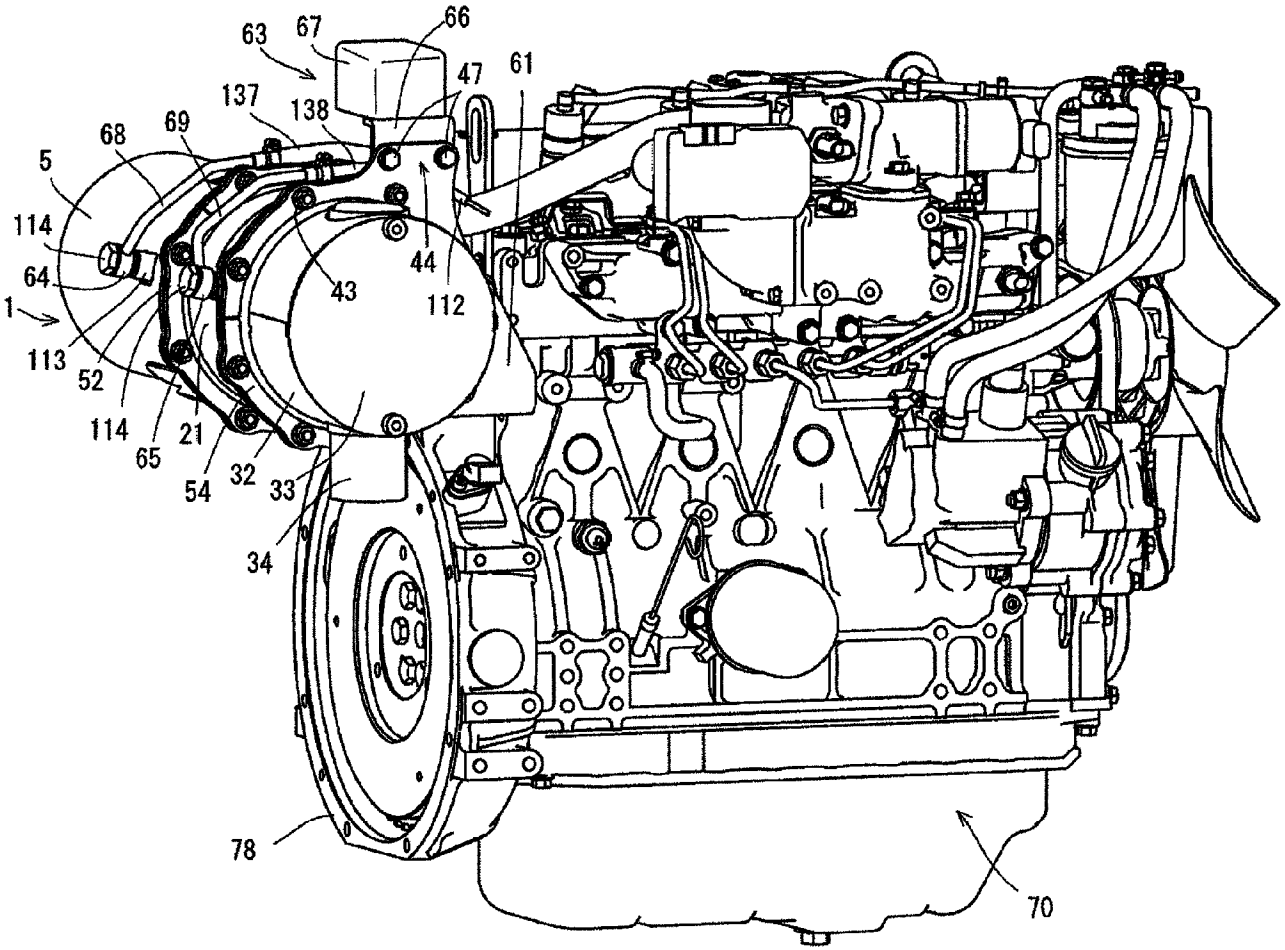
FIG. 17 is a back elevational perspective view of the diesel engine which is provided with the DPF.
Figure 18:
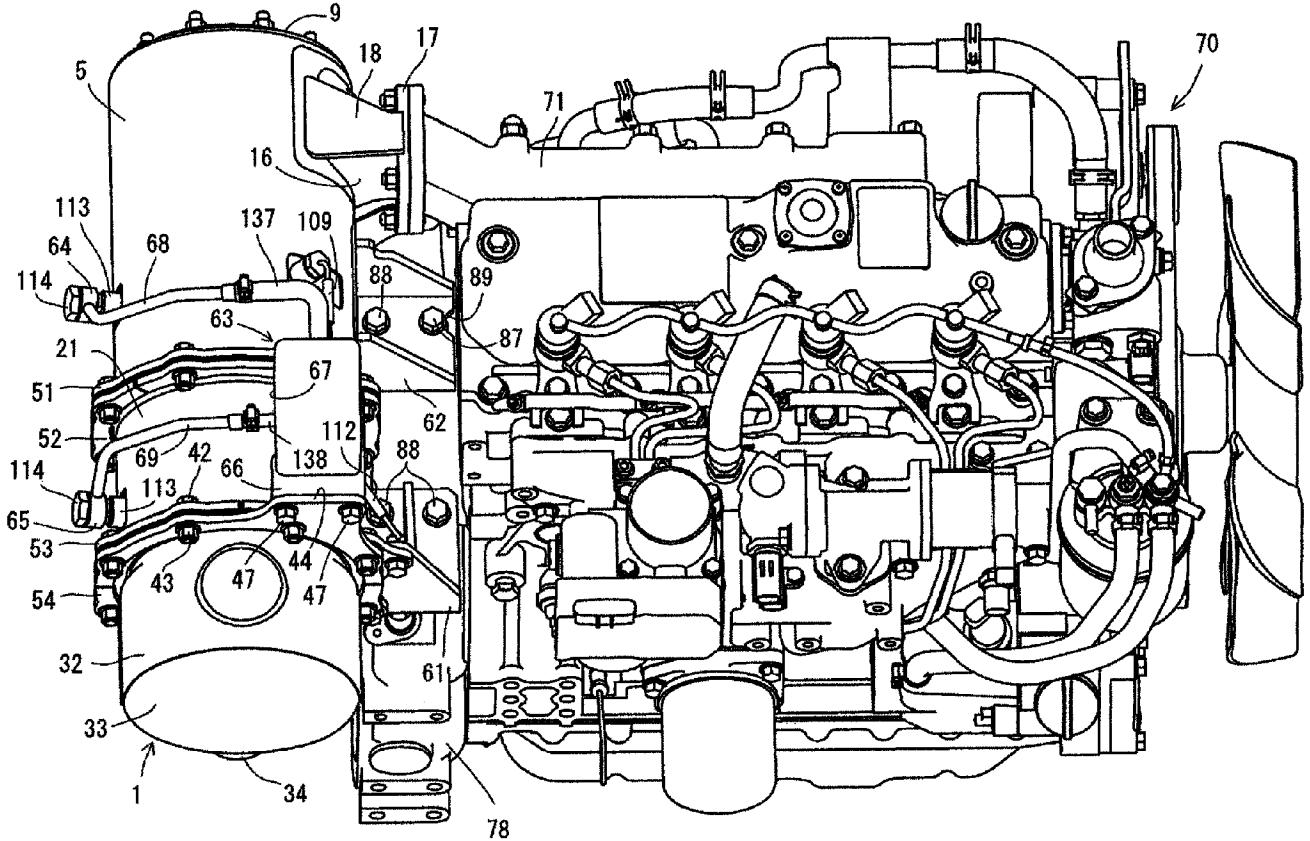
FIG. 18 is a plan perspective view of the diesel engine which is provided with the DPF.
Figure 19:
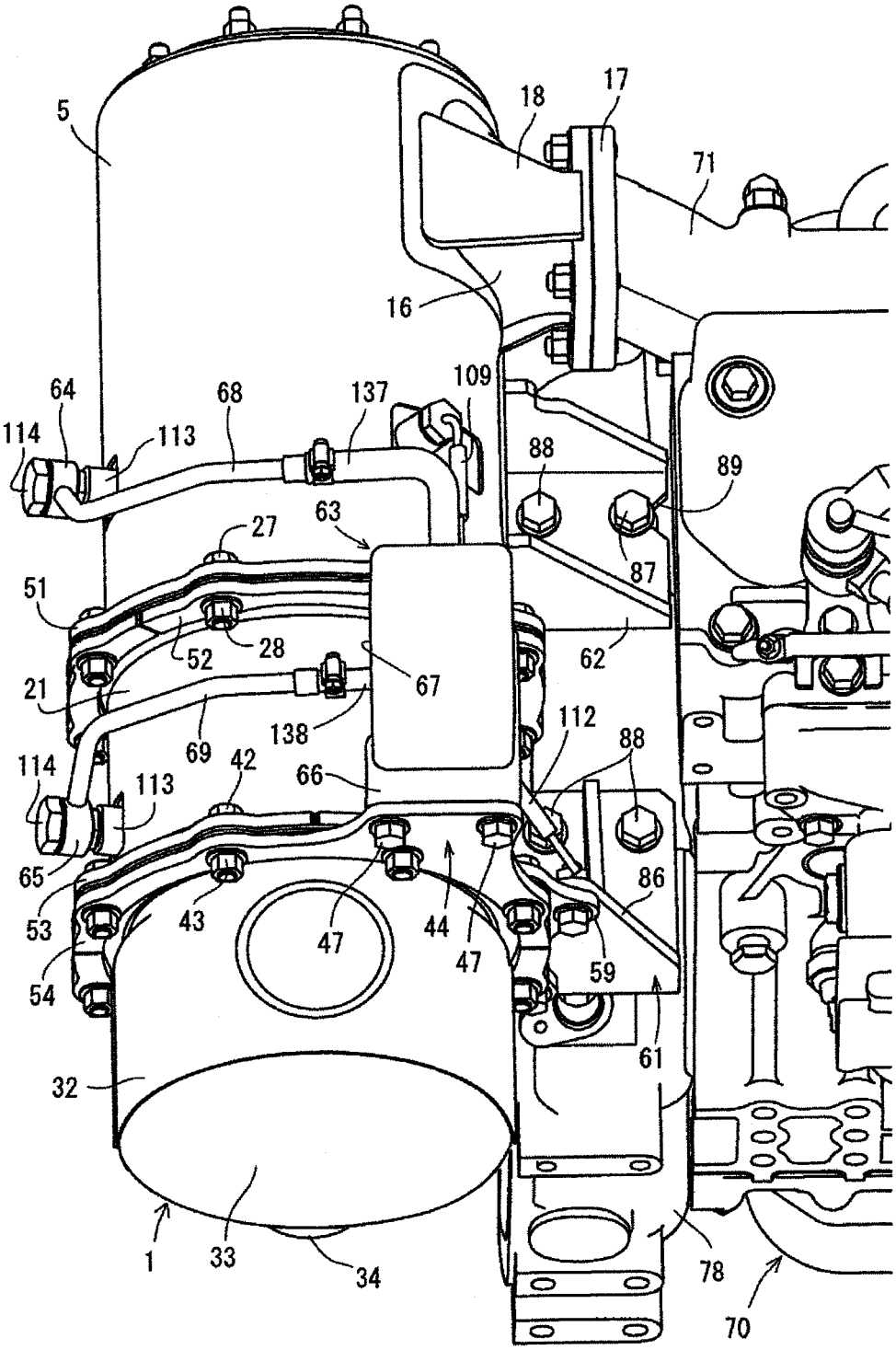
FIG. 19 is a partly enlarged view in FIG. 18.

As shown in FIG. 13, FIG. 15 and FIG. 19, the sensor boss body 113 serving as the sensor piping body is provided in the catalyst inside case 4 (the filter inside case 20) serving as the exhaust gas purifying case. The upstream side pipe joint body 64 (the downstream side pipe joint body 65) for connecting the sensor piping is fastened to the sensor boss body 113 via the pipe joint bolt 114, and the upstream side sensor piping 68 (the downstream side sensor piping 69) made of a steel pipe is extended from the sensor boss body 113 toward the differential pressure sensor 67 serving as the exhaust gas pressure sensor, along the outer peripheral shape of the catalyst outside case 5 (the filter outside case 21) serving as the exhaust gas purifying case. The differential pressure sensor 67 is connected to the upstream side sensor piping 68 (the downstream side sensor piping 69) via an upstream side flexible pipe 137 (a downstream side flexible pipe 138) made of a rigid resin.

Figure 20:
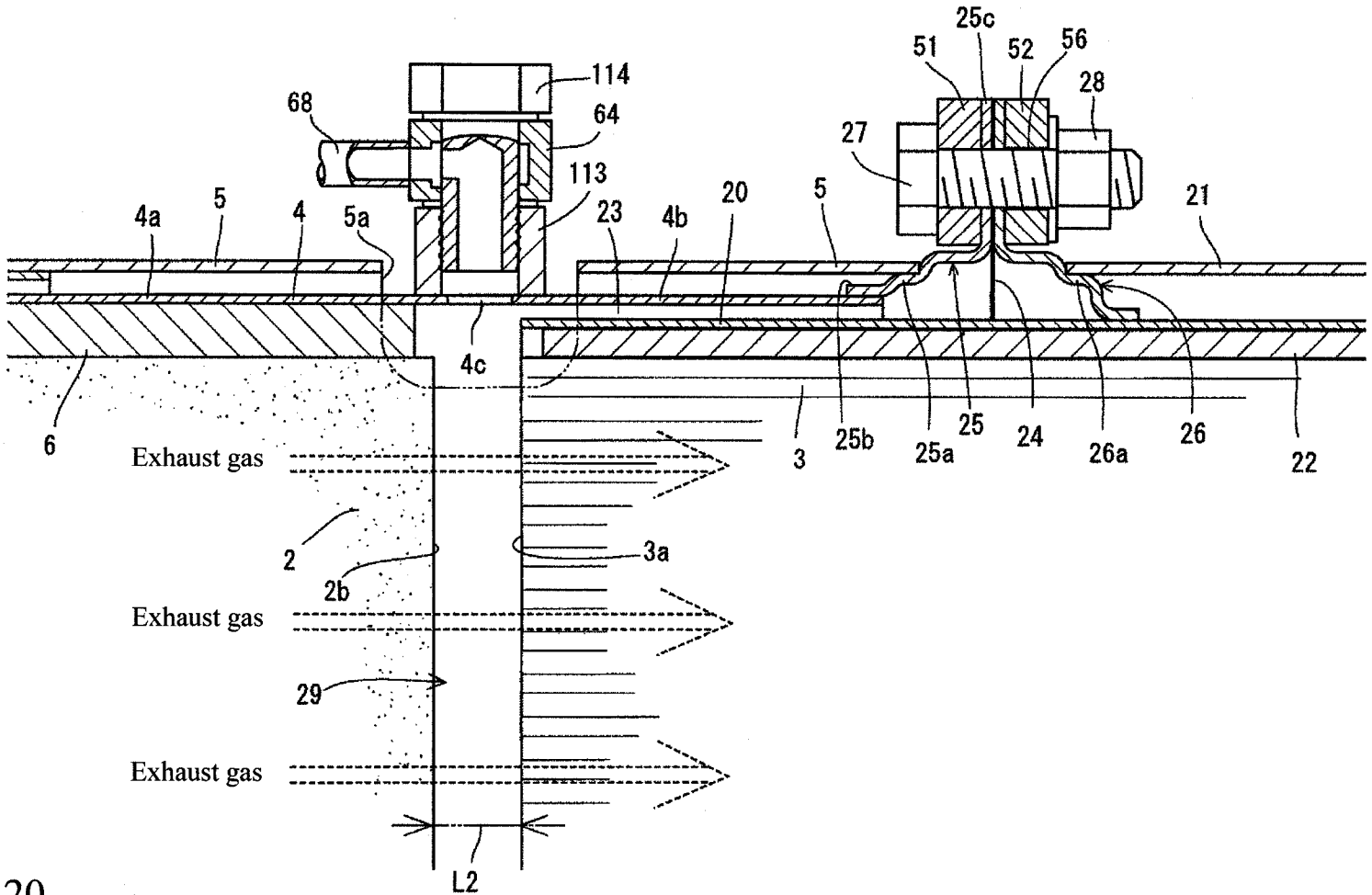
FIG. 20 is an enlarged cross sectional view showing an attaching portion of a sensor boss body for a differential pressure sensor.

As shown in FIG. 20, the sensor boss body 113 is firmly fixed to the outer peripheral surface of the catalyst inside case 4 in the vicinity of the gas outflow side end face 2*b* of the diesel oxidation catalyst 2. One end side of the cylindrical sensor boss body 113 is fixed by welding to the outer peripheral surface of the catalyst inside case 4. The upstream side pipe joint body 64 is fastened to the sensor boss body 113 by the pipe joint bolt 114. The detection main body 67 of the differential pressure sensor 63 is connected to the upstream side pipe joint body 64 via the upstream side sensor piping 68.

Further, a sensor opening 4*c* which communicates a hollow portion of the sensor boss body 113 with the catalyst downstream side space 29 is formed in the catalyst inside case 4. It is structured such that the exhaust gas is discharged from the gas outflow side end face 2*b* of the diesel oxidation catalyst 2 to the catalyst downstream side space 29, whereby a part of the exhaust gas within the catalyst downstream side space 29 moves to the detection main body 67 side via the sensor opening 4*c*, the hollow portion of the sensor boss body 113, a hollow portion of the upstream side pipe joint body 64, and the upstream side sensor piping 68.

As shown in FIG. 1, FIG. 10 and FIG. 13 to FIG. 20, it is provided with the diesel oxidation catalyst 2 or the soot filter 3 which serves as the gas purifying body purifying the exhaust gas discharged from the diesel engine 70, the catalyst inside case 4, the catalyst outside case 5, the filter inside case 20 and the filter outside case 21 which serve as the exhaust gas purifying case inward provided with the gas purifying body, and the differential pressure sensor 63 which serves as the exhaust gas pressure sensor detecting the exhaust gas pressure of the diesel oxidation catalyst 2 or the soot filter 3. Further, the differential pressure sensor 63 is arranged in an outer side surface of the catalyst outside case 5 or the filter outside case 21. Accordingly, it is not necessary to evaluate the initial setting (adjusting) condition of the differential pressure sensor 63 per the plural specifications of diesel engines 70 or machine bodies. It is possible to reduce an evaluating man power for a design of assembling the DPF 1 in the diesel engine 70, a test or the like. By arranging the differential pressure sensor 63 in the DPF 1, it is not necessary to evaluate the DPF 1 for each of the plural specifications of diesel engines 70. Accordingly, it is possible to reduce a manufacturing cost by standardizing the constructing parts relevant to the DPF 1 and reducing the number of the constructing parts relevant to the DPF 1. It is unnecessary to evaluate the differential pressure sensor 63 per the plural specifications of diesel engines 70 or machine bodies, and it is possible to improve a detecting precision of the differential pressure sensor 63 as well as reducing a development cost.

As shown in FIG. 10, and FIG. 13 to FIG. 19, the sensor support portion 44 is integrally formed in a part of the inlet pinching flange 54 which serves as the flange body of the catalyst outside case 5 or the filter outside case 21, and the sensor bracket 66 for attaching the differential pressure sensor 63 is detachably provided in the sensor support portion 44. Accordingly, it is possible to support the differential pressure sensor 63 in the inlet pinching flange 54 having a high rigidity, and it is possible to reduce a vibration of the differential pressure sensor 63. It is possible to prevent the differential pressure sensor 63 from falling away. It is possible to easily secure a strength of the catalyst inside case 4 or the catalyst outside case 5 or the filter inside case 20 or the filter outside case 21 which constructs the DPF 1, or a support strength of the differential pressure sensor 63.

As shown in FIG. 1, FIG. 13 to FIG. 18, the outlet pinching flange 53 which serves as the flange body for attaching the filter outside case 21 is detachably fastened to the inlet pinching flange 54 for attaching the differential pressure sensor 63. Accordingly, it is possible to support the differential pressure sensor 63 to the inlet pinching flange 54 having a high rigidity, and it is possible to reduce a vibration of the differential pressure sensor 63. It is possible to prevent the differential pressure sensor 63 from falling away. It is possible to easily secure the support strength of the exhaust gas purifying case, or the support strength of the differential pressure sensor 63. It is possible to assemble with a high rigidity the DPF 1 and the differential pressure sensor 63 to the diesel engine 70, the machine body or the like via the inlet pinching flange 54 for attaching the differential pressure sensor 63 and the outlet pinching flange 53 for attaching the filter outside case 21.

As shown in FIG. 10 and FIG. 13 to FIG. 20, the sensor boss body 113 which serves as the sensor piping body is provided in the catalyst inside case 4 or the filter inside case 20, the pipe joint bodies 64 and 65 for connecting the sensor pipings 68 and 69 are fastened to the sensor boss body 113 via the pipe joint bolt 114, and the sensor pipings 68 and 69 which are connected to the DPF 1 and the differential pressure sensor 63 are extended from the sensor boss body 113 toward the differential pressure sensor 63 along the outer peripheral shape of the catalyst outside case 5 or the filter outside case 21. Accordingly, the sensor pipings 68 and 69 can be compactly arranged in the outer periphery of the DPF 1. Further, it is possible to extend the sensor pipings 68 and 69 in an optional direction from the pipe joint bodies 64 and 65 toward the differential pressure sensor 63. It is possible to improve an assembling workability of the DPF 1 (the exhaust gas purifying case) to the diesel engine 70 or the like. In comparison with the conventional structure in which the sensor pipings 68 and 69 are extended from the DPF 1 to the diesel engine 70 or the machine body side, a worker or a tool is hard to come into contact with the sensor pipings 68 and 69 or the like at a time of an assembling work or a maintenance work of the diesel engine 70 or the DPF 1, and it is possible to easily protect the sensor pipings 68 and 69 or the like. It is possible to improve a handling workability such as a carriage of the DPF 1.

Figure 21:
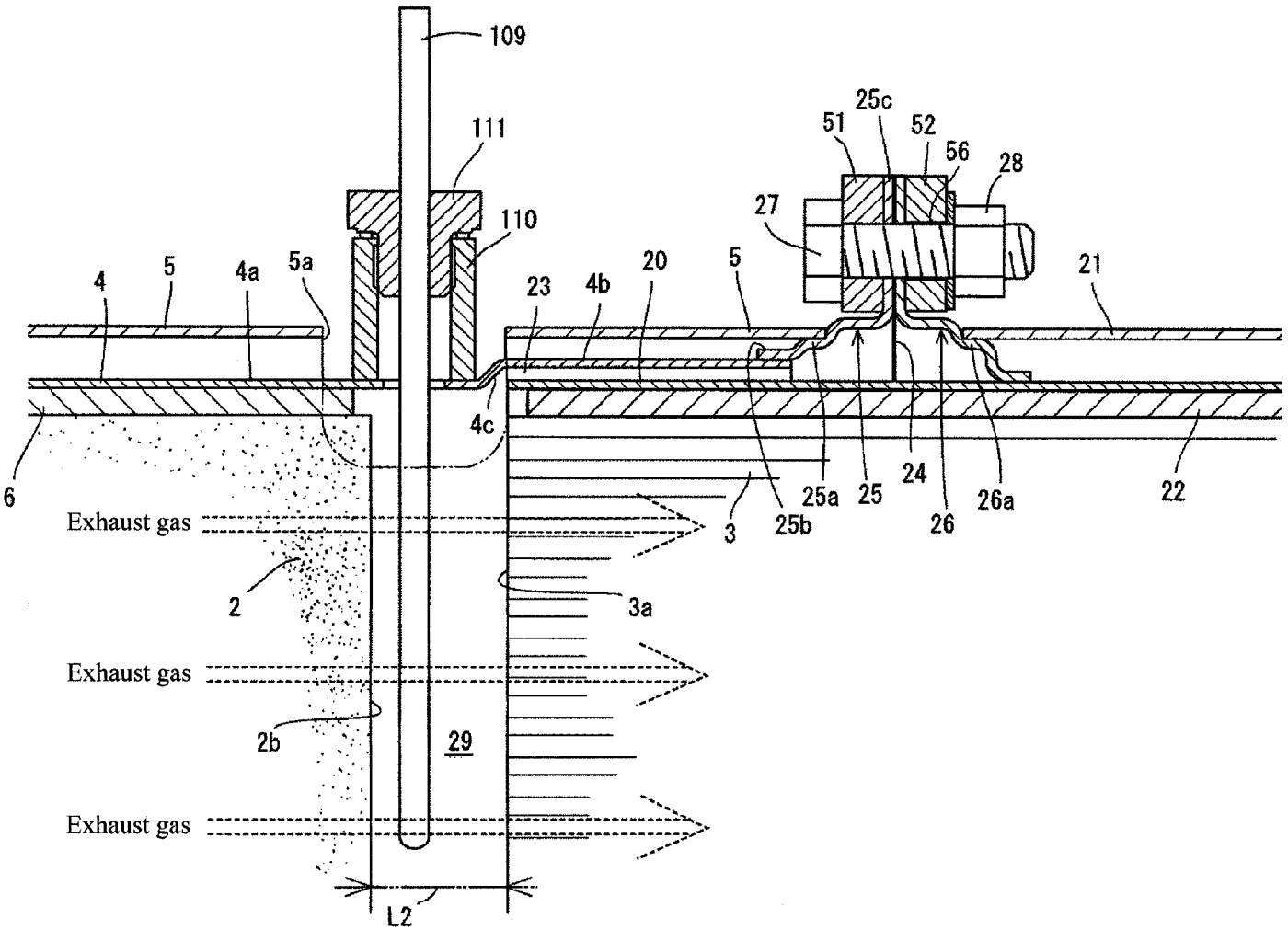
FIG. 21 is an enlarged cross sectional view showing an attaching portion of a sensor boss body according to a second embodiment.

Next, a description will be given of a second embodiment of the DPF 1 (the exhaust gas purifying device) according to the present invention with reference to FIG. 21. FIG. 21 is an enlarged cross sectional view showing an attaching portion of a sensor boss body according to the second embodiment. A catalyst inside case 4 is constructed by an upstream side tube portion 4*a* which accommodates a diesel oxidation catalyst 2, and a downstream side tube portion 4*b* to which a filter inside case 20 is inserted. The upstream side tube portion 4*a* is formed as a cylindrical shape having a smaller diameter than the downstream side tube portion 4*b*. The upstream side tube portion 4*a* and the downstream side tube portion 4*b* are integrally connected via a step portion 4*c*. A sensor boss body 110 is fixed by welding to an outer peripheral surface of the upstream side tube portion 4*a* which is positioned close to the step portion 4*c* in an outer peripheral surface of the upstream side tube portion 4*a*. The sensor boss body 110 can be firmly fixed to a high rigidity position of the upstream side tube portion 4*a* which is close to the step portion 4*c*, by utilizing the upstream side tube portion 4*a*. Gas temperature sensors 109 and 112 can be supported so as to be close to a gas outflow side end face 2*b* of the diesel oxidation catalyst 2. In this case, the upstream side tube portion 4*a* having the smaller diameter and the filter inside case 20 are formed as a cylindrical shape having the same diameter.

Figure 22:
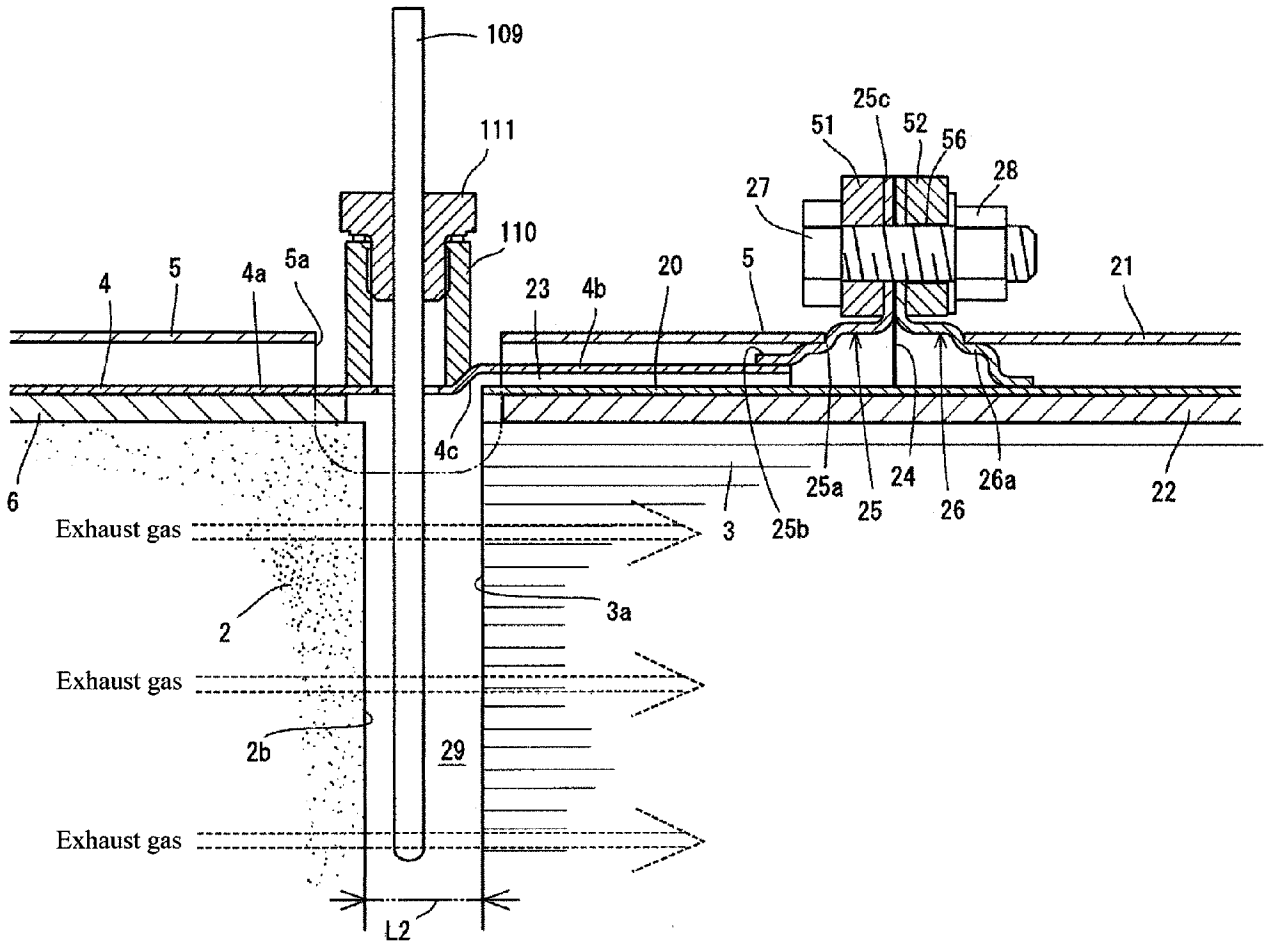
FIG. 22 is an enlarged cross sectional view showing an attaching portion of a sensor boss body according to a third embodiment.

Next, a description will be given of a third embodiment of the DPF 1 (the exhaust gas purifying device) according to the present invention with reference to FIG. 22. FIG. 22 is an enlarged cross sectional view showing an attaching portion of a sensor boss body according to the third embodiment. A catalyst inside case 4 is constructed by an upstream side tube portion 4*a* which accommodates a diesel oxidation catalyst 2, and a downstream side tube portion 4*b* to which a filter inside case 20 is inserted. The upstream side tube portion 4*a* is formed as a cylindrical shape having a smaller diameter than the downstream side tube portion 4*b*. The upstream side tube portion 4*a* and the downstream side tube portion 4*b* are integrally connected via a step portion 4*c*. A sensor boss body 110 is fixed by welding to an outer peripheral surface of the upstream side tube portion 4*a* which is positioned close to the step portion 4*c*, and the step portion 4*c*, in an outer peripheral surface of the upstream side tube portion 4*a*. The sensor boss body 110 can be firmly fixed to a high rigidity position of the catalyst inside case 4, by utilizing the upstream side tube portion 4*a* and the step portion 4*c*. It is possible to reduce a mechanical vibration of gas temperature sensors 109 and 112. In this case, the upstream side tube portion 4*a* having the smaller diameter and the filter inside case 20 are formed as a cylindrical shape having the same diameter.

Figure 23:
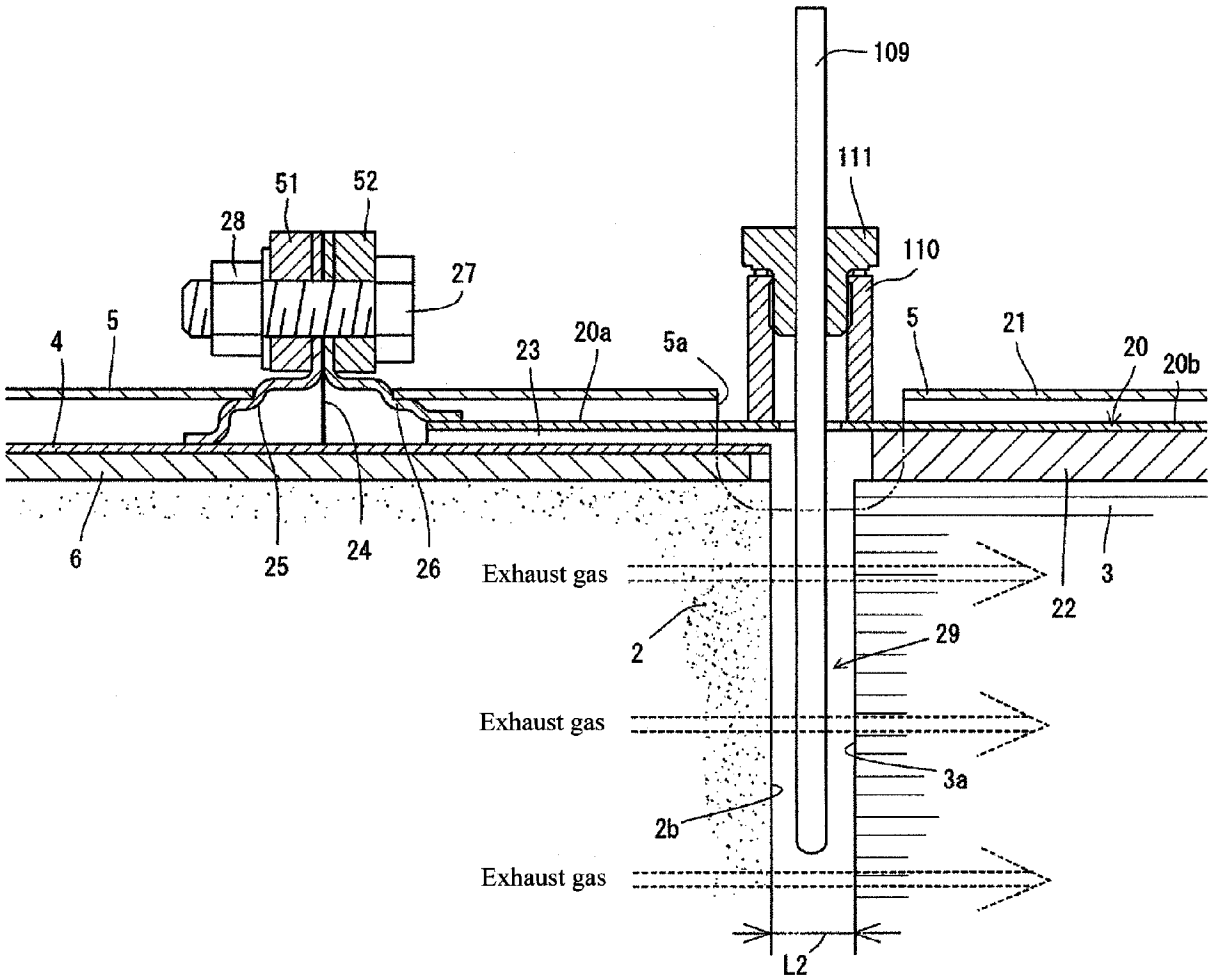
FIG. 23 is an enlarged cross sectional view showing an attaching portion of a sensor boss body according to a fourth embodiment.

Next, a description will be given of a fourth embodiment of the DPF 1 (the exhaust gas purifying device) according to the present invention with reference to FIG. 23. FIG. 23 is an enlarged cross sectional view showing an attaching portion of a sensor boss body according to the fourth embodiment. A filter inside case 20 is constructed by an upstream side tube portion 20*a* to which a catalyst inside case 4 is inserted, and a downstream side tube portion 20*b* which accommodates a soot filter 3. The catalyst inside case 4 is formed as a cylindrical shape having a smaller diameter than the filter inside case 20. In other words, the catalyst inside case 4 and the filter inside case 20 are formed as a cylindrical shape having a straight ridge line, and are formed such that diameters in both end sides are equal. On the other hand, a sensor boss body 110 is firmly fixed to an upstream side tube portion 20*a*, and a gas temperature sensor 109 is protruded into the upstream side tube portion 20*a* which is a catalyst downstream side space 29. In this case, an end portion of the upstream side tube portion 20*a* is detachably fixed to an outer peripheral surface of the catalyst inside case 4, via junction flanges 25 and 26, in an upstream side of a gas outflow side end face 2*b* of the diesel oxidation catalyst 2. The fourth embodiment has the same effect as the first embodiment.

Figure 24:
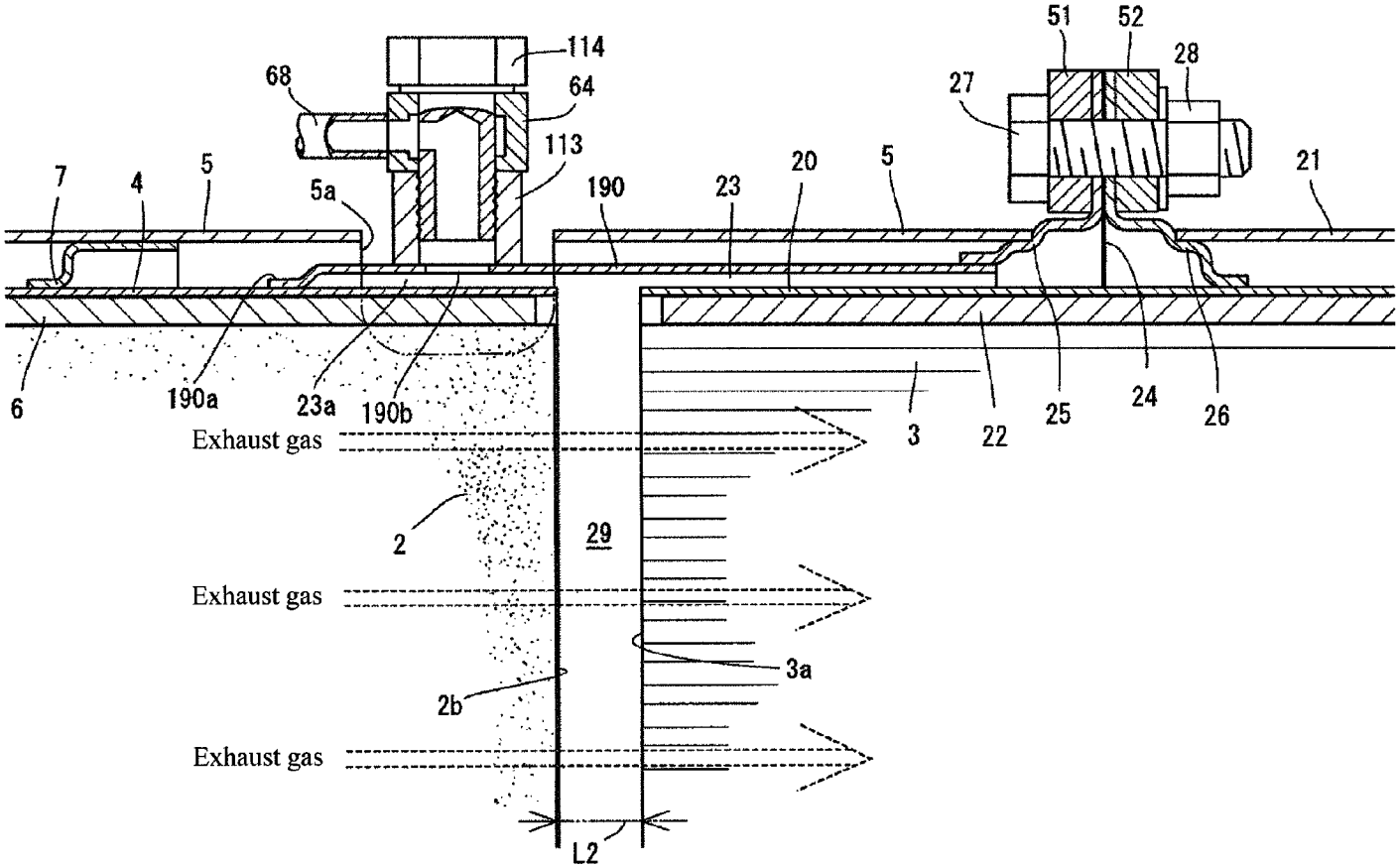
FIG. 24 is an enlarged cross sectional view showing an attaching portion of a sensor boss body according to a fifth embodiment.
Figure 25:
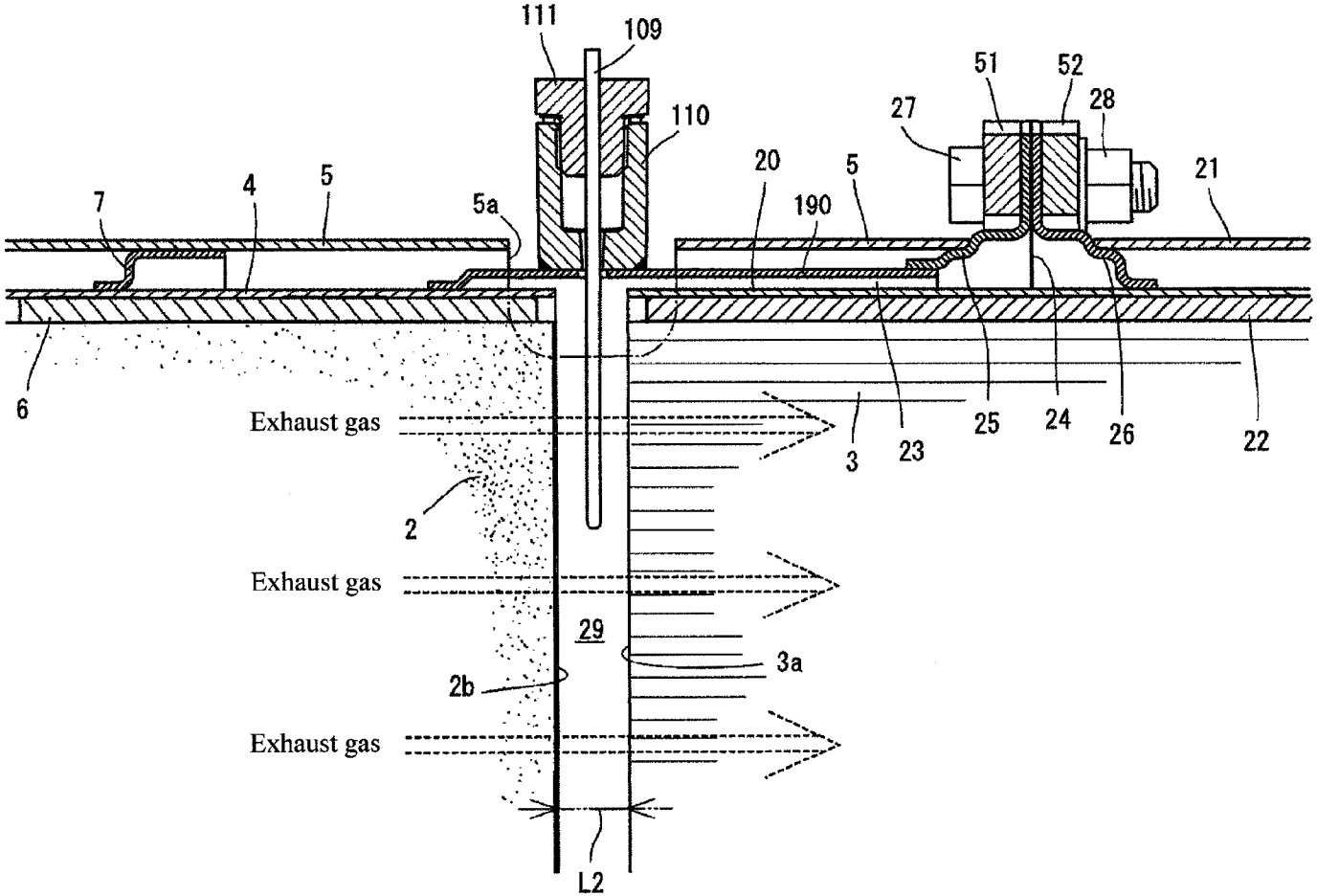
FIG. 25 is an enlarged cross sectional view showing an attaching portion of a sensor boss body according to a sixth embodiment.

Next, a description will be given of a fifth embodiment and a sixth embodiment of the DPF 1 (the exhaust gas purifying device) according to the present invention with reference to FIG. 24 and FIG. 25. FIG. 24 is an enlarged cross sectional view showing an attaching portion of a sensor boss body according to the fifth embodiment. FIG. 25 is an enlarged cross sectional view showing an attaching portion of a sensor boss body according to the sixth embodiment. As shown in FIG. 24 or FIG. 25, a heat shield case 190 is provided in an outer surface of one of the catalyst inside case 4 in the catalyst inside case 4 or the filter inside case 20. The catalyst inside case 4 and the filter inside case 20 are formed as a cylindrical shape having the same diameter. In other words, the catalyst inside case 4 and the filter inside case 20 are formed as a cylindrical shape having a straight ridge line, and are formed such that diameters in both end sides are equal. A downstream side gap 23 which is the same as the first embodiment is formed between outer peripheral surfaces of the catalyst inside case 4 and the filter inside case 20, and an inner peripheral surface of the heat shield case 190.

As shown in FIG. 24 or FIG. 25, an upstream side of the heat shield case 190 is formed as a cylindrical shape having a smaller diameter than a downstream side, a small-diameter cylindrical upstream side end portion 190*a* of the heat shield case 190 is bonded to the outer peripheral surface of the catalyst inside case 4, and an upstream side of the heat shield case 190 is fixed by welding to the catalyst inside case 4. One end side of the heat shield case 190 is firmly fixed to an outer peripheral surface which is inside the downstream side end face of the one of the catalyst inside case 4. On the other hand, an upstream side (an exhaust gas intake side end portion) of the other of the filter inside case 20 is inserted into the heat shield case 190. A catalyst downstream side space 29 which is the same as the first embodiment is formed between a gas outflow side end face 2*b* of the diesel oxidation catalyst 2 within the catalyst inside case 4, and one side end face (an intake side end face) 3*a* of the soot filter 3 within the filter inside case 20.

As shown in FIG. 24 or FIG. 25, the inside cases 4 and 20, the heat shield case 190 and the catalyst outside case 5 are provided as a three-layer structure, a downstream side end of the heat shield case 190 is formed shorter than a downstream side end of the catalyst outside case 5, and a downstream side end of the catalyst inside case 4 is formed shorter than a downstream side end of the heat shield case. In other words, one end side (an upstream side) of the heat shield case 190 is fitted to the one of the catalyst inside case 4, and the other end side of the heat shield case is connected by welding to a catalyst side junction flange 25 which serves as a flange body for bonding the outside cases 5 and 21. A sensor attaching opening 5*a* of the catalyst outside case 5 is occluded by the heat shield case 190. On the other hand, the other end side (a downstream side) of the heat shield case 190 which is extended to the outer surface of the other of the filter inside case 20 is connected to the catalyst side junction flange 25 which serves as the flange body for bonding the outside cases 5 and 21. A downstream side gap 23 which serves as a space is formed between an outer peripheral side of the other of the filter inside case 20 to which the other end side (the downstream side) of the heat shield case 190 is extended, and an inner peripheral side of the heat shield case 190.

As shown in FIG. 24 or FIG. 25, a sensor boss body 113 or 110 is firmly attached to an outer peripheral surface of the heat shield case 190 in the vicinity of the end face of the one of the catalyst inside case 4. An inner diameter of a firmly attaching position of the sensor boss body 113 or 110 in the heat shield case 190 is formed larger than an outer diameter of the catalyst inside case 4 (the filter inside case 20).

As shown in FIG. 24, an upstream side gap 23*a* is formed between the catalyst inside case 4 and the heat shield case 190, in an upstream side of a downstream side end portion of the catalyst inside case 4. One end side of the cylindrical sensor boss body 113 is fixed by welding to an outer peripheral surface in an upstream side of the heat shield case 190. An upstream side pipe joint body 64 is fastened to the sensor boss body 113 by a pipe joint bolt 114. A detection main body 67 of the differential pressure sensor 63 is connected to the upstream side pipe joint body 64 via an upstream side sensor piping 68.

As shown in FIG. 24, a sensor opening 190*b* which communicates a hollow portion of the sensor boss body 113 is formed in an upstream side gap 23*a*. It is structured such that an exhaust gas is discharged from the gas outflow side end face 2*b* of the diesel oxidation catalyst 2 to the catalyst downstream side space 29, whereby a part of the exhaust gas within the catalyst downstream side space 29 moves to a detection main body 67 side via the upstream side gap 23*a*, the sensor opening 190*b*, the hollow portion of the sensor boss body 113, the hollow portion of the upstream side pipe joint body 64 and the upstream side sensor piping 68.

In the structure mentioned above, when the exhaust gas within the catalyst downstream side space 29 moves in a direction of the sensor opening 190*b*, the particulate matter included in the exhaust gas is piled up between the corner of the downstream side end portion of the catalyst inside case 4 and the heat shield case 190. Therefore, in comparison with the structure in which the sensor opening is directly open toward the catalyst downstream side space 29, an amount of the particulate matter piled up in an opening edge of the sensor opening 190*b* is reduced. It is possible to maintain an exhaust gas inflow pressure of the sensor opening 190*b* equal to or less than a predetermined pressure.

Particularly, since it is possible to form an area of the upstream side gap 23*a* which is formed over a whole periphery between the catalyst inside case 4 and the heat shield case 190, larger than an area of the sensor opening 190*b*, the exhaust gas is supplied to the sensor opening 190*b* from the other of the upstream side gap 23*a*, even if the particulate matter is piled up in a part of the upstream side gap 23*a* between the catalyst inside case 4 and the heat shield case 190. In other words, it is possible to continuously operate the diesel engine 70 for a long time period until the particulate matter is piled up in a whole region of the upstream side gap 23*a* which is formed over a whole periphery of the catalyst inside case 4 and the heat shield case 190. It is possible to set an interval of a maintenance work for removing the particulate matter piled up in the sensor opening 190*b* longer. It is possible to maintain a detecting precision of the differential pressure sensor 63 for a long time period, while the diesel engine 70 can be continuously operated for a long time period.

As shown FIG. 25, one end side of the cylindrical sensor boss body 110 is fixed by welding to an outer peripheral surface of the heat shield case 190 (a position at which the catalyst downstream side space 29 is formed). The other end side of the sensor boss body 110 is extended in a radial direction from the sensor attaching opening 5*a* of the catalyst outside case 5 toward an outer side of the case 5. A sensor attaching bolt 111 is attached by screw to the other end side of the sensor boss body 110. A thermistor type upstream side gas temperature sensor 109 is passed through the sensor attaching bolt 111, and the upstream side gas temperature sensor 109 is supported to the sensor boss body 110 via the sensor attaching bolt 111. A detecting portion of the upstream side gas temperature sensor 109 is protruded into the catalyst downstream side space 29.

In the structure mentioned above, for example, since a part of the sensor boss body 110 can be positioned in an upstream side of the gas outflow side end face 2*b* of the diesel oxidation catalyst 2, the sensor boss body 110 can be arranged in the outer peripheral surface of the heat shield case 190 in such a manner as to make the upstream side gas temperature sensor 109 close to the gas outflow side end face 2*b* until being in contact with the gas outflow side end face 2*b* of the diesel oxidation catalyst 2. Further, it is possible to make a thickness of each of the inside cases 4 and 20, and the heat shield case 190 thin by making a thickness of each of the outside cases 5 and 21 thick, and it is possible to achieve a weight saving of the DPF 1 while it is possible to maintain the soot filter 3 equal to or higher than a regeneration temperature.

As shown in FIG. 1, FIG. 9, FIG. 12 and FIG. 21 to FIG. 25, there are provided with a diesel oxidation catalyst 2 or a soot filter 3 which purifies the exhaust gas discharged from the diesel engine 70, a catalyst inside case 4 or a filter inside case 20 which is inward provided with the diesel oxidation catalyst 2 or the soot filter 3, and a catalyst outside case 5 or a filter outside case 21 which is inward provided with the catalyst inside case 4 or the filter inside case 20. Further, an outlet end portion (a gas outflow side end portion) of the catalyst inside case 4 in an exhaust upstream side and an inlet end portion (a gas intake side end portion) of the filter inside case 20 in an exhaust downstream side are overlapped as a double structure, sensor boss bodies 110 and 113 for supporting the exhaust gas sensor are arranged in an outer surface of an outlet end portion or an inlet end portion of the double structure, and the sensor boss bodies 110 and 113 are extended to an outer side of the catalyst outside case 5. In this case, a differential pressure sensor (an exhaust gas pressure sensor) 63, and an upstream side gas temperature sensor (an exhaust gas temperature sensor) 109 are provided as the exhaust gas sensor.

Accordingly, it is possible to easily assemble the piping 68 of the upstream side gas temperature sensor 109 (the exhaust gas temperature sensor) or the differential pressure sensor 63 (the exhaust gas pressure sensor), via the sensor boss bodies 110 and 113. Further, it is possible to easily reduce the lowering of the exhaust gas temperature within the catalyst inside case 4 or the filter inside case 20, on the basis of a heat insulating (a heat keeping) action of the catalyst outside case 5 or the filter outside case 21. It is possible to reduce a stay of the particulate matter in the exhaust gas in the inner portion of the soot filter 3 by maintaining the exhaust gas temperature in the filter inside case 20, it is not necessary to regenerate the soot filter 3 at a high frequency, and it is possible to improve a purifying performance of the exhaust gas. On the other hand, since a rise of an outer surface temperature of the catalyst outside case 5 or the filter outside case 21 is suppressed, it is possible to carry out a maintenance of the diesel engine 70 before the DPF 1 or the diesel engine 70 is cooled, and it is possible to improve a handling workability.

As shown in FIG. 24 or FIG. 25, the heat shield case 190 is provided in the outer surface of the one of the catalyst inside case 4, the other of the filter inside case 20 is inserted into the heat shield case 190, one end side of the heat shield case 190 is firmly fixed to an outer peripheral surface which is in an inner side than the end face of the one of the catalyst inside case 4, and the sensor boss body 110 is firmly fixed to an outer peripheral surface of the heat shield case 190 in the vicinity of the end face of the one of the catalyst inside case 4.

Accordingly, the catalyst outside case 5 and the heat shield case 190 can be extended to a position at which the diesel oxidation catalyst 2 and the soot filter 3 are opposed, and it is possible to easily maintain the exhaust gas temperature within the filter inside case 20 by the catalyst outside case 5 and the heat shield case 190. Further, it is possible to make a distance L2 between the opposed diesel oxidation catalyst 2 and the soot filter 3 as a shortest dimension, while it is possible to form the catalyst inside case 4 and the filter inside case 20 at the same diameter. In other words, in comparison with the conventional structure which is provided with the expanded portion, it is possible to form a distance between the end face of the diesel oxidation catalyst 2 and the attaching position of the upstream side gas temperature sensor 109 as a shortest dimension (zero or an optional dimension) without being affected by an expanded margin of the catalyst inside case, a radius and a welding margin of the sensor boss body. As a result, it is possible to shorten a whole length of the DPF 1 and it is possible to easily mount the DPF 1 to the various equipments. It is possible to move the upstream side gas temperature sensor 109 closer until being in contact with the end face of the diesel oxidation catalyst 2, and it is possible to improve a control performance of an automatic regenerating process of the DPF 1.

As shown in FIG. 24 or FIG. 25, since an inner diameter of the position to which the sensor boss body 110 is firmly fixed, in the heat shield case 190 is formed larger than the outer diameter of the catalyst inside case 4 or the filter inside case 20, the downstream side gap 23 is formed between the heat shield case 190 and the filter inside case 20 which is inward inserted to the heat shield case 190, whereby it is possible to easily extract the filter inside case 20 from the heat shield case 190. Further, it is possible to improve a heat insulating property of the position at which the diesel oxidation catalyst 2 and the soot filter 3 are opposed, by the heat shield case 190 and the catalyst outside case 5. It is possible to easily maintain the oxidizing process temperature (the regenerating temperature) of the particulate matter in the exhaust gas which the soot filter 3 collects.

As shown in FIG. 24 or FIG. 25, since one end side of the heat shield case 109 is fitted to the catalyst inside case 4, and the other end side of the heat shield case 190 is connected to the catalyst side junction flange 25 (the flange body) for bonding the outside cases 5 and 21, it is possible to support at a high rigidity the heat shield case 190 by the catalyst inside case 4 and the catalyst side junction flange 25. It is possible to easily prevent the exhaust gas within the catalyst inside case 4 or the filter inside case 20 from leaking toward the outside cases 5 and 21 from the downstream side gap 23 with the heat shield case 190. It is possible to reduce a rise of a surface temperature of the outside cases 5 and 21.

As shown in FIG. 24 or FIG. 25, since the sensor attaching opening 5*a* (the sensor attaching hole) of the catalyst outside case 5 is occluded by the heat shield case 190, it is possible to make the sensor boss bodies 110 and 113 protrude to the outer direction of the catalyst outside case 5 so as to easily connect the upstream side sensor piping 68 of the differential pressure sensor 63 or the upstream side gas temperature sensor 109 (the exhaust gas sensor) to a measuring portion. It is possible to easily extend an electric wiring and a piping from the side of the sensor boss bodies 110 and 113. Further, it is possible to easily prevent the exhaust gas within the catalyst inside case 4 or the filter inside case 20 from leaking out of the sensor attaching opening 5*a*. It is possible to reduce a rise of the surface temperature of the catalyst outside case 5 or the filter outside case 21.

As shown in FIG. 24 or FIG. 25, since the downstream side gap 23 is formed between the outer peripheral side of the other of the filter inside case 20 to which the other end side of the heat shield case 190 is extended, and the inner peripheral side of the heat shield case 190, it is possible to easily make the other of the filter inside case 20 come in and out with respect to the heat shield case 190, and it is possible to easily bond or separate the inside cases 4 and 20 and the outside cases 5 and 21. It is possible to improve a maintenance workability of the diesel oxidation catalyst 2 and the soot filter 3 which serve as the gas purifying body, or the gas temperature sensor 109, the downstream side gas temperature sensor 112 and the differential pressure sensor 63 which serve as the exhaust gas sensor.

As shown in FIG. 24 or FIG. 25, since the other end side of the heat shield case 190 which is extended to the outer surface of the other of the filter inside case 20 is connected to the catalyst side junction flange 25 (the flange body) for bonding the catalyst outside case 5 and the filter outside case 21, it is possible to easily prevent the exhaust gas from leaking from the diesel oxidation catalyst 2 toward the outside cases 5 and 21. It is possible to reduce the lowering of the exhaust gas temperature of the soot filter 3, and the rise of the surface temperature of the outside cases 5 and 21, on the basis of the heat insulating action of the outside cases 5 and 21 and the heat shield case 190.

As shown in FIG. 24 or FIG. 25, since the catalyst inside case 4 (the filter inside case 20), the heat shield case 190 and the catalyst outside case 5 (the filter outside case 21) are provided as a three-layer structure, a side end of the heat shield case 190 is formed shorter than a side end of the catalyst outside case 5 (the filter outside case 21), and a side end of the catalyst inside case 4 (the filter inside case 20) is formed shorter than a side end of the heat shield case 190, it is possible to reduce the lowering of the exhaust gas temperature, and it is possible to improve a processing efficiency of the particulate matter in the exhaust gas. It is possible to reduced the rise of the surface temperature of the catalyst outside case 5 (the filter outside case 21), and it is possible to improve a workability of a maintenance or the like of the diesel engine 70 which is required during its operation.

REFERENCE SIGNS LIST

1 DPF (diesel particulate filter)
2 Diesel oxidation catalyst (gas purifying body)
3 Soot filter (gas purifying body)
4 Catalyst inside case
5 Catalyst outside case
5*a* Sensor attaching opening (sensor attaching hole)
20 Filter inside case
21 Filter outside case
25 Catalyst side junction flange
44 Sensor support portion
53 Outlet pinching flange in filter outlet side
54 Inlet pinching flange in sound absorbing side
63 Differential pressure sensor (exhaust gas sensor)
64 Upstream side pipe joint body
65 Downstream side pipe joint body
66 Sensor bracket
68 Upstream side sensor piping
69 Downstream side sensor piping
70 Diesel engine
109 Upstream side gas temperature sensor (exhaust gas sensor)
110 Sensor boss body
113 Sensor boss body
114 Pipe joint bolt

The invention claimed is:

1. An exhaust gas purifying device comprising:

a plurality of gas purifying bodies which purifies an exhaust gas discharged by an engine;

a plurality of inside cases which is inward provided with the respective gas purifying bodies; and outside cases which are inward provided with the respective inside cases; and wherein an outlet end portion of the inside case in an exhaust gas upstream side and an inlet end portion of the inside case in an exhaust gas downstream side are superposed as a double structure, a sensor boss body for supporting an exhaust gas pressure sensor is arranged in an outside surface of the outlet end portion or the inlet end portion of the double structure, and the sensor boss body is extended to an outside direction of the outside case; and wherein a heat shielding case which is the outside surface of a first inside case is provided on the inside of the outside case, a second inside case is inserted into the heat shielding case, one end side of the heat shielding case is attached to the outer circumferential surface on the inward side of the end surface of the first inside case, and a sensor boss body is attached to the outer circumferential surface of the heat shielding case proximal to the end surface of the first inside case.

2. The exhaust gas purifying device according to claim 1, wherein an inner diameter of a firmly fixing position of the sensor boss body in the heat shield case is formed larger than an outer diameter of the inside case.

3. The exhaust gas purifying device according to claim 1, wherein one end side of the heat shield case is fitted to the inside case, and the other end side of the heat shield case is coupled to a flange body for bonding the outside cases.

4. The exhaust gas purifying device according to claim 1, wherein a sensor attaching hole of the outside case is occluded by the heat shield case.

5. The exhaust gas purifying device according to claim 1, wherein a space is formed between an outer peripheral side of the other of the inside case in which the other end side of the heat shield case is extended, and an inner peripheral side of the heat shield case.

6. The exhaust gas purifying device according to claim 1, wherein the other end side of the heat shield case which is extended to the outside surface of the other of the inside case is coupled to a flange body for connecting the outside cases.

7. The exhaust gas purifying device according to claim 1, wherein the inside case, the heat shield case and the outside case are provided as a three-layer structure, a side end of the heat shield case is formed shorter than a side end of the outside case, and a side end of the inside case is formed shorter than a side end of the heat shield case.

8. The exhaust gas purifying device according to claim 1, wherein the exhaust gas pressure sensor is arranged in an outside surface of the outside case, a pipe joint body for connecting the sensor piping is fastened to the sensor boss body via a pipe joint bolt, and the exhaust gas pressure sensor is connected to the sensor boss body via the sensor piping.

9. The exhaust gas purifying device according to claim 8, wherein a sensor support portion is integrally formed in a part of a flange body for pinching in the outside case, and a sensor bracket for attaching the exhaust gas pressure sensor is detachably provided in the sensor support portion.

10. The exhaust gas purifying device according to claim 8, wherein the sensor piping is extended from the sensor piping body toward the exhaust gas pressure sensor, along an outer peripheral shape of the exhaust gas purifying case.

* * * * *